US006095040A

United States Patent [19]

Ashikagaya et al.

[11] Patent Number: 6,095,040

[45] **Date of Patent: *Aug. 1, 2000**

[54] STENCIL PRINTER AND INK VISCOSITY SENSING DEVICE

[75] Inventors: Atsushi Ashikagaya, Ohgawara-machi; Takayuki Onodera, Iwanuma, both of Japan

[73] Assignee: Tohoku Ricoh Co., ltd., Shibata-gun, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/813,331

[22] Filed: Mar. 7, 1997

[30] Foreign Application Priority Data

May 29, 1996 [JP] Japan ..... 8-135292
Dec. 13, 1996 [JP] Japan ..... 8-333531

[51] Int. Cl.[7] ..... B41L 13/00

[52] U.S. Cl. ..... 101/120; 101/116

[58] Field of Search ..... 101/114, 116, 101/119, 120, 129; 73/54.02, 54.31, 54.23, 54.35

[56] References Cited

U.S. PATENT DOCUMENTS 3,875,791 4/1975 Fitzgerald et al. ..... 73/59
5,218,903 6/1993 MacConnell et al. ..... 101/350.2
5,394,739 3/1995 Garvey, III et al. ..... 73/54.23
5,537,920 7/1996 Hasegawa et al. ..... 101/116

FOREIGN PATENT DOCUMENTS 64-18682 1/1989 Japan .
2-151473 6/1990 Japan .
3-13344 1/1991 Japan .
5-201115 8/1993 Japan .
5-229243 9/1993 Japan .
6-155880 6/1994 Japan .
6-155881 6/1994 Japan .
6-155882 6/1994 Japan .
6-199028 7/1994 Japan .
6-340162 12/1994 Japan .
7-017013 1/1995 Japan .

*Primary Examiner*—Ren Yan
*Attorney, Agent, or Firm*—Oblon, Spivak, McClelland, Maier & Neustadt, P.C.

[57] ABSTRACT

A stencil printer or similar printer and an ink viscosity sensing device therefor are disclosed. The viscosity of ink which is the root cause of the degradation of image equality ascribable to, e.g., temperature and down time is directly sensed. The viscosity is combined with other information including a set print speed and the kind of the ink in order to effect delicate print pressure control matching the actual conditions of the printer. Stable image quality with a minimum of fluctuation is achievable against the varying environment and without resorting to complicated control pattern tables or a number of sensors.

6 Claims, 19 Drawing Sheets

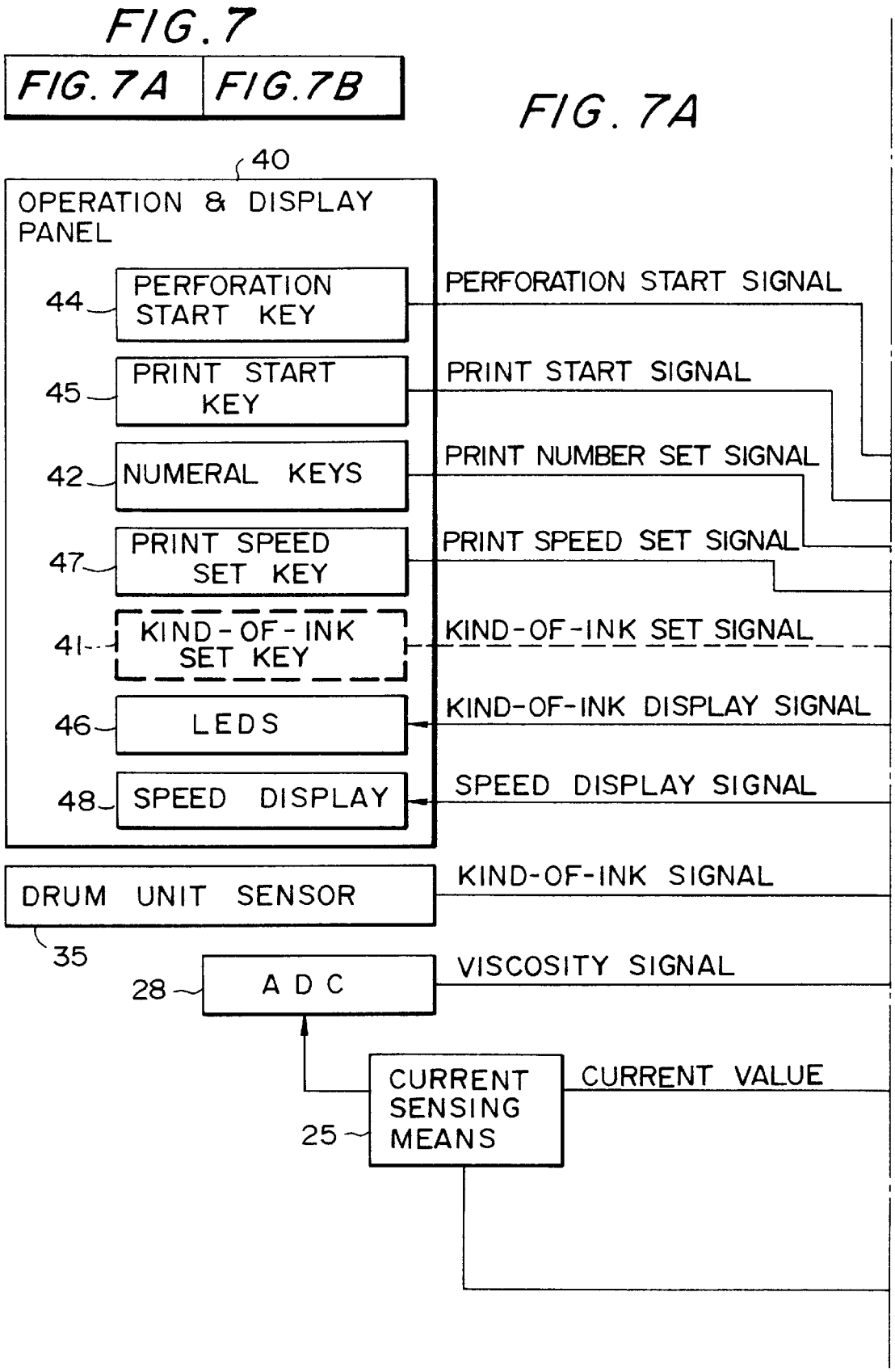
FIG. 7
FIG. 7A
FIG. 7B
FIG. 7A
40
OPERATION & DISPLAY PANEL
44
PERFORATION START KEY
45
PRINT START KEY
42
NUMERAL KEYS
47
PRINT SPEED SET KEY
41
KIND-OF-INK SET KEY
46
LEDS
48
SPEED DISPLAY
PERFORATION START SIGNAL
PRINT START SIGNAL
PRINT NUMBER SET SIGNAL
PRINT SPEED SET SIGNAL
KIND-OF-INK SET SIGNAL
KIND-OF-INK DISPLAY SIGNAL
SPEED DISPLAY SIGNAL
DRUM UNIT SENSOR
35
KIND-OF-INK SIGNAL
28
A D C
VISCOSITY SIGNAL
CURRENT SENSING MEANS
25
CURRENT VALUE

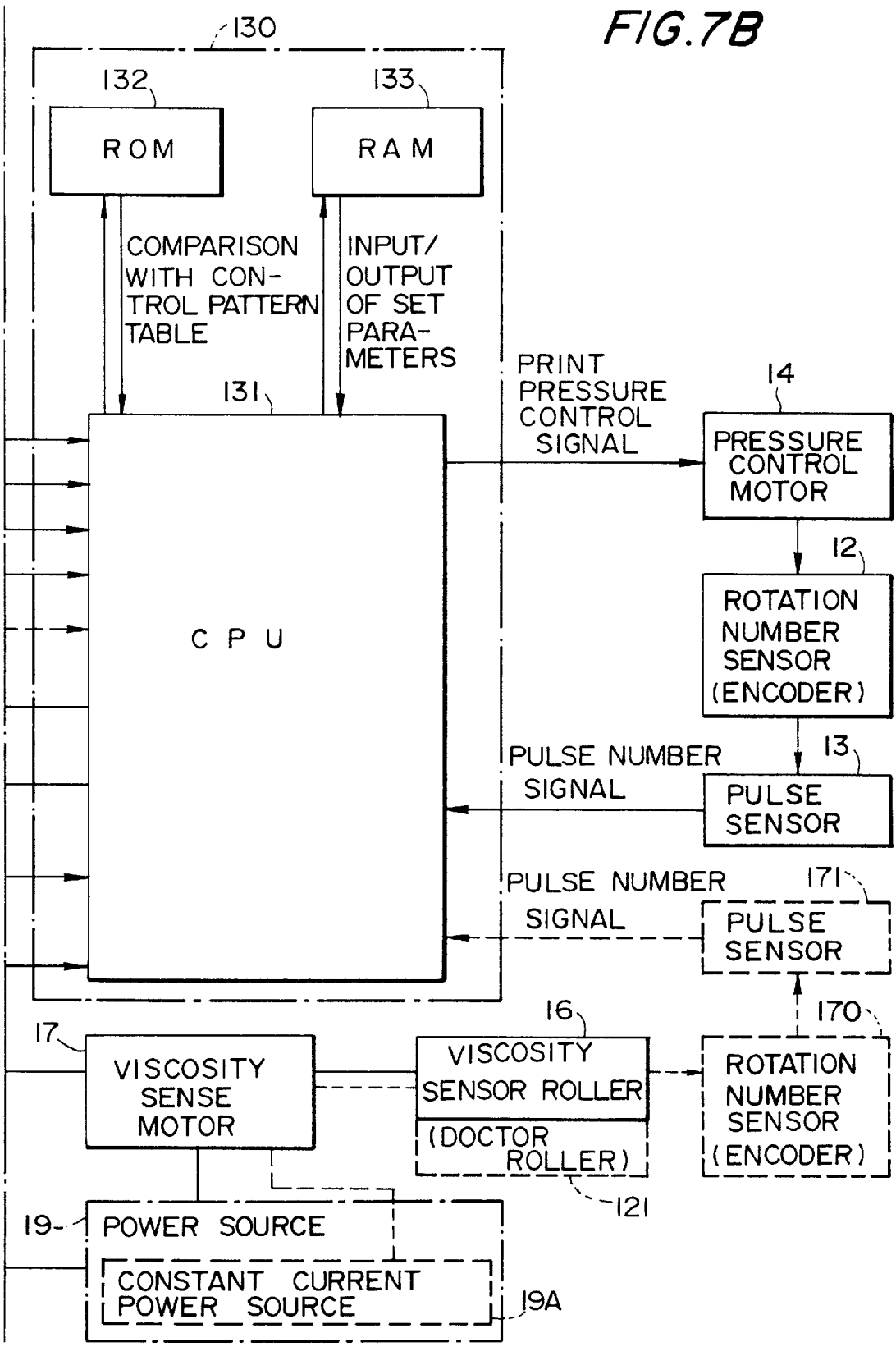
FIG.7B
130
132
133
ROM
RAM
COMPARISON WITH CONTROL PATTERN TABLE
INPUT/ OUTPUT OF SET PARAMETERS
131
CPU
PRINT PRESSURE CONTROL SIGNAL
14
PRESSURE CONTROL MOTOR
12
ROTATION NUMBER SENSOR (ENCODER)
13
PULSE NUMBER SIGNAL
PULSE SENSOR
PULSE NUMBER SIGNAL
171
PULSE SENSOR
170
ROTATION NUMBER SENSOR (ENCODER)
17
VISCOSITY SENSE MOTOR
16
VISCOSITY SENSOR ROLLER
(DOCTOR ROLLER)
121
19
POWER SOURCE
CONSTANT CURRENT POWER SOURCE
19A 101
104
13
12
20A
11
15
14
10
9
8
7
6
129
125a
125
127a, 127b
128
126
127c
22A 50
60
80
81
82
83
84
90
61a
61b
91
92
93a
93b
94a
94b
95
96
61
110
111
112a
112b
113a
113b
62
51
100
101
102
103
104
61c
119
120
121
122
123
124
A
114
115
116
117
118
X
55
52
53
62a
70
71a
71b
72a
72b
73a
73b
74

STENCIL PRINTER AND INK VISCOSITY SENSING DEVICE

BACKGROUND OF THE INVENTION

1. Field of the Invention

The present invention relates to a stencil printer or similar printer and an ink viscosity sensing device therefor.

2. Discussion of the Background

A thermosensitive digital stencil printer is extensively used today as a simple and convenient printer. The stencil printer uses a stencil having a laminate structure comprising of a thermoplastic resin film and a porous substrate formed of Japanese paper fibers or synthetic fibers or a mixture thereof. The surface of the stencil where the film is present is brought into contact with the heating elements of a thermal head or master making means. At the same time, the thermal head is energized in the main scanning direction in accordance with image data output from a document reading section. As a result, the film surface of the stencil is selectively perforated by heat to form an image in the form of a perforation pattern. While the perforated part of the stencil, i.e., a master, is conveyed by a platen roller and other rollers in the subscanning direction, the master is automatically wrapped around a print drum which is a porous hollow cylinder. Then, ink feeding means disposed in the print drum feeds ink while a press roller or similar pressing means presses a sheet against the drum via the master continuously. As a result, the ink oozes out via a porous portion included in the drum and the perforations of the master, printing an image on the sheet. This kind of printer is disclosed in, e.g., Japanese Patent Laid-Open Publication No. 5-229243.

The ink for use in the stencil printer is, in many cases, implemented by emulsion ink containing a pigment, resin, solvent, surfactant, water, and so forth. As to viscosity, emulsion ink greatly depends on the environment due to temperature and humidity during operation, evaporation of water ascribable to a long down time, and so forth, as generally accepted. The viscosity of ink is one of critical factors which effect the amount of ink transfer to a sheet. Specifically, the viscosity of ink has critical influence on the quality of printed images, e.g., image density, evenness of a solid image, and offset.

To compensate for the environment dependency of the ink viscosity and thereby image quality, the pressure of the press roller acting on the print drum (print pressure hereinafter) may be varied, as taught in, e.g., Japanese Patent Laid-Open Publication Nos. 2-151473, 6-155880, 6-155881, 6-155882, and 6-199028. Schemes taught in these documents each use a control pattern table listing the variations of image quality in relation to various parameters including print speed, temperature, and down time. The actual print speed, temperature, down time and so forth sensed by various sensors arranged in the printer are compared with the control pattern table. Then, the print pressure is adequately controlled to correct the variation of image quality ascribable to the above parameters, insuring stable image quality at all times.

However, none of the above prior art schemes senses, or measures, the viscosity of ink directly effecting image quality or feeds it back as viscosity data. The prior art schemes simply use the ambient temperature, down time and other indirect data as so-to-speak substitute characteristic values for the viscosity of ink. Therefore, the print pressure cannot be delicately set in matching relation to actual conditions which differ from one machine to another machine. Moreover, the actual behavior of ink in the printer is apt to deviate from the data listed in the control pattern table. This kind o f deviation cannot be coped with and prevents a desired effect from being achieved.

The viscosity after a long down time, among others, is effected even by humidity. The conventional schemes described above cannot deal with this problem alone, i.e., they need humidity sensing means and other additional implementations which would further complicate the control.

The control pattern table cannot be prepared unless t h e variation of image quality is determined by experiments with respect to some different parameters including print speed, temperature, down time, and the kind of ink. Such an amount of data is difficult to deal with. In addition, a plurality of sensors are necessary for determining the variations of the individual parameters. Consequently, the control itself is unavoidably complicated and constitutes a heavy load on the development and design stage.

Conventional technologies relating to the present invention are also disclosed in, e.g., Japanese Patent Laid-Open Publication Nos. 64-18682, 5-201115, 6-340162, 7-17013, and 3-13344.

SUMMARY OF THE INVENTION

It is therefore an object of the present invention to provide a stencil printer capable of directly detecting a change in the viscosity of ink which is the root cause of the variation of image quality ascribable temperature, down time, and so forth, capable of effecting delicate control over the print pressure in matching relation to the actual conditions of the individual printer by combining a set print speed, the kind of ink (print drum) and so forth with the sensed viscosity, and thereby insuring stable image quality sparingly susceptible to the environment without resorting to a complicated control pattern table or a number of sensors.

It is another object of the present invention to provide an ink viscosity sensing device for sensing and measuring the viscosity of ink of an ink layer formed on the ink applying surface of ink feeding means.

A stencil printer for wrapping a master around a print drum, feeding ink to the master, and pressing a sheet against the print drum with a pressing member to thereby print an image on the sheet of the present invention includes a pressure varying section for varying the pressure of the pressing member acting on the print drum. A viscosity sensing device senses the viscosity of the ink. A pressure variation control section selects, based on the viscosity sensed by the viscosity sensing device, a particular pressure of the pressing member out of a control pattern table prepared beforehand, and controls the pressure varying section such that the particular pressure acts on the print drum.

Also, a device for sensing the viscosity of ink of the present invention includes a viscosity sense roller contacting the ink applying surface of an ink feeding member via an ink layer. A roller drive mechanism causes the viscosity sense roller to rotate at a constant speed. A power source applies power to the roller drive mechanism. A current sensing device senses a current applied from the power source to the roller drive mechanism. The viscosity is determined on the basis of a change in the current.

BRIEF DESCRIPTION OF THE DRAWINGS

The above and other objects, features and advantages of the present invention will become apparent from the following detailed description taken with the accompanying drawings in which:

FIG. 7 is a block diagram schematically showing a control system applicable to the embodiment of FIG. 1 as well as to other embodiments to follow;

DESCRIPTION OF THE PREFERRED EMBODIMENTS

Figure 1:
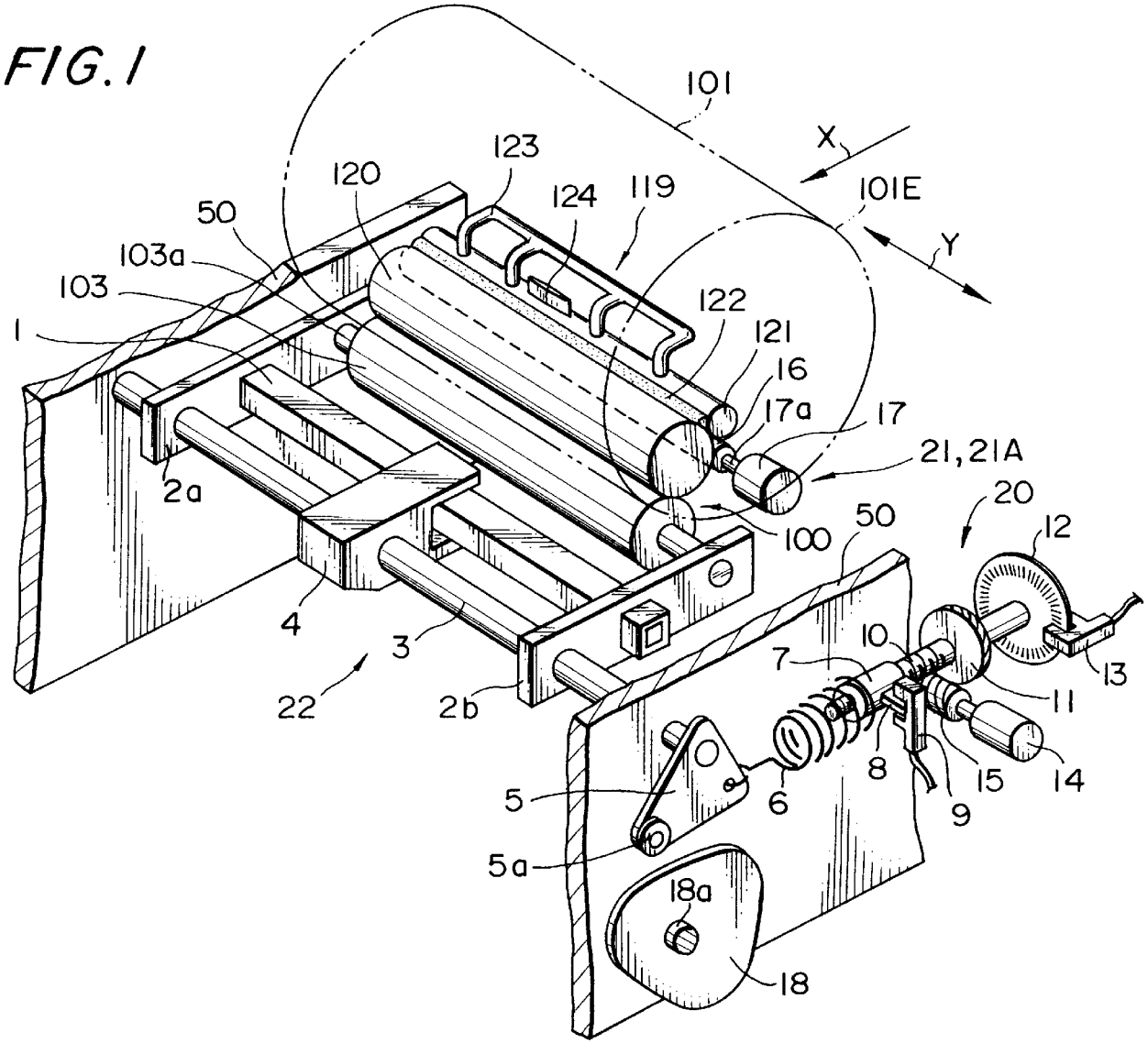
FIG. 1 is a fragmentary perspective view of a stencil printer embodying the present invention.

Preferred embodiments of the stencil printer and ink viscosity sensing device in accordance with the present invention will be described. In the drawings, various structural elements are sometimes omitted for simplicity so long as the omission does not obstruct the understanding of the present invention. As for identical structural elements provided in pairs, only one of them will be described for the clarity of description. The downstream side and upstream side with respect to the direction of sheet transport will be sometimes referred to as "front" and "rear", respectively. Also, the right-hand side and left-hand side in the widthwise direction of a sheet, i.e., the direction perpendicular to the direction of sheet transport will sometimes be referred to as "right (rear in the direction perpendicular to the surfaces of the drawings)" and "left (front in the same direction)", respectively. In the drawings, identical reference numerals denote identical structural elements.

Figure 18:
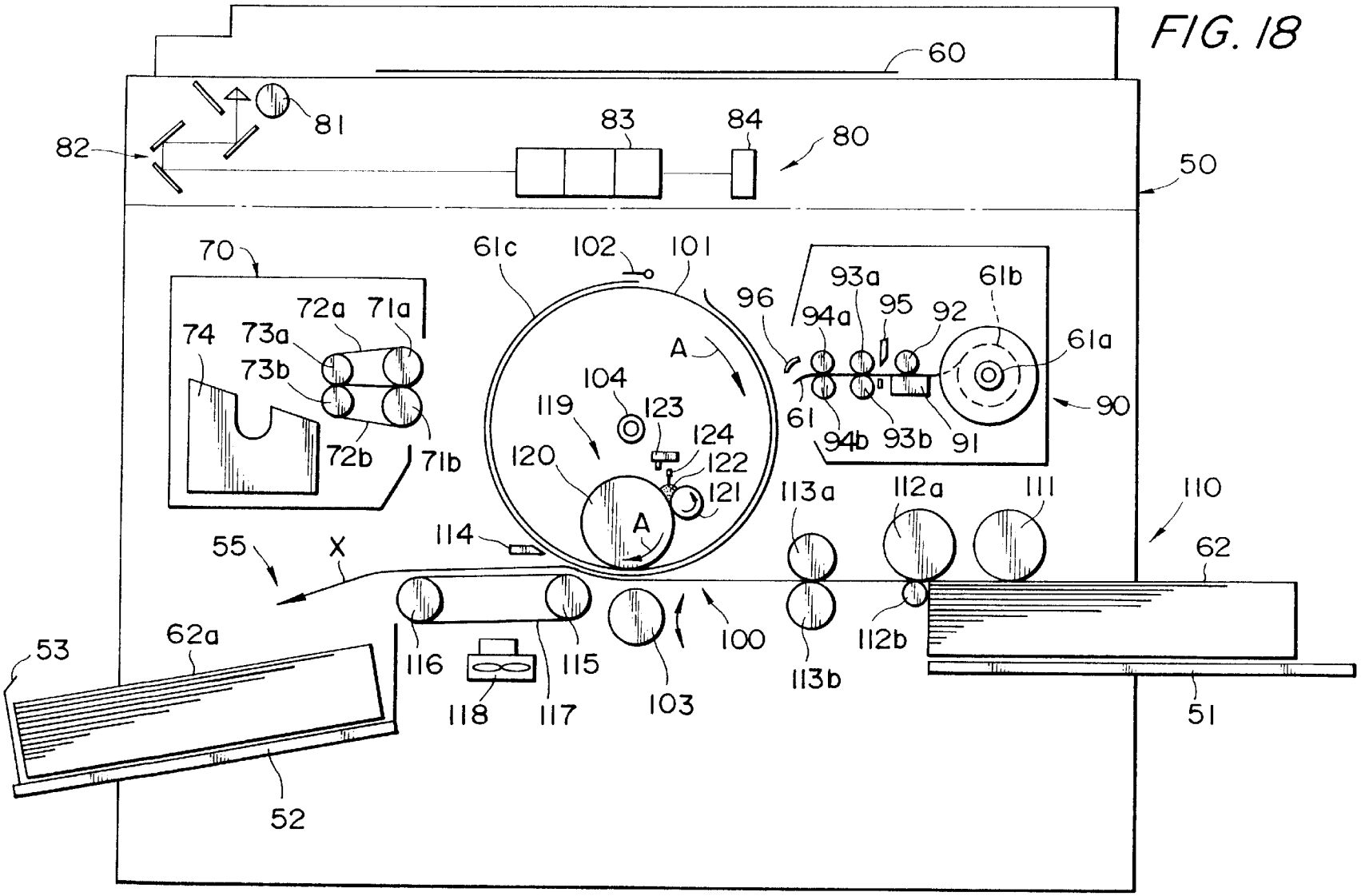
FIG. 18 shows the general construction of a stencil printer to which the present invention is applicable.

Referring to FIG. 18, a digital stencil printer to which the present invention is applicable is shown. The general construction and printing process of the stencil printer will be outlined first. As shown, the printer includes a pair of body frames 50 (only one is visible) positioned at the right-hand side and left-hand side, respectively. In FIG. 1 as well as in other drawings, the body frames 50 are shown with an exaggerated thickness. As shown in FIG. 18, a document reading section 80 is arranged in the upper portions of the body frames 50. A master making and feeding section 90 is located below the document reading section 80. A print drum 101 is positioned at the left-hand side of the above section 90 and implemented as a porous hollow cylinder. A master discharging section 70 is located at the left-hand side of the print drum 101. A sheet feeding section 110 is disposed below the section 90. A pressing section 100 is located below the print drum 101. A sheet discharging section 55 is positioned below the master discharging section 70 at the left-hand side of the pressing section 100.

The operation of the stencil printer will be described with reference also made to FIG. 3. First, the operator sets a desired document on a glass platen, not shown, mounted on the top of the image reading section 80. Then, the operator presses a perforation start key 44 positioned on an operation and display panel 40 which is shown only in FIG. 3. In response, the print drum 101 carrying a used master 61 on its outer periphery starts rotating in the direction opposite to the direction indicated by an arrow A. When the trailing edge of the master 61 on the drum 101 approaches a pair of peel rollers 71*a* and 71*b* included in the master discharging section 70, the rollers 71*a* and 71*b* in rotation peel off the trailing edge of the master 61. A conveyor belt 72*a* is passed over the peel roller 71*a* and a discharge roller 73*a* while a conveyor belt 72*b* is passed over the peel roller 71*b* and a discharge roller 73*b*. The conveyor belts 72*a* and 72*b*, constituting a conveying device, convey the master 61 while sequentially peeling it off from the drum 101. The master 61 is collected in a box 74. At this time, the drum 101 is continuously rotating counterclockwise, as viewed in FIG. 18. A compressing plate, not shown, compresses the master 61 collected in the box 74.

In parallel with the above master discharging step, the image reading section 80 reads the document 60 by the conventional reduction type document reading system. The document 60 read by the reading section 80 is driven out to a tray, not shown. Specifically, while the document 60 is sequentially conveyed on the glass platen, not shown, a fluorescent lamp 81 illuminates it. The resulting reflection from the document 60 is incident to a CCD (Charge Coupled Device) or similar image sensor 84 via mirrors 82 and a lens 83. The image sensor 84 transforms the incident imagewise light to a corresponding electric signal. The electric signal is sent to an analog-to-digital converter board, not shown, included in the body frames 50 and transformed to a digital image signal thereby.

In the document reading section 80, a mechanism having C various functions for color separation which implements color printing is positioned on an optical path between the mirrors 82 and the lens 83. For example, the mechanism has the same functions and configuration as a filter unit taught in, e.g., Japanese Patent Laid-Open Publication No. 64-18682 mentioned earlier, and is capable of selectively positioning a plurality of color filters on the optical path. The automatic master making, master feeding and other steps available with such a mechanism will not be described.

In parallel with the document reading operation, a master is made on the basis of the digital image data and fed, as follows. A stencil 61 is implemented as a roll 61*b* wound round a core 61*a*. The core 61*a* is rotatably supported by support members, not shown, included in the master making and feeding section 90. The stencil 61 is paid out from the roll 61*b*. A platen roller 92 is pressed against a thermal head 91 with the intermediary of the stencil 61. The platen roller 92 and a pair of feed rollers 93*a* and 93*b* are rotated at a constant speed, conveying the stencil 61 to the downstream side of the stencil transport path. The thermal head 91 has an array of numerous small heating elements arranged in the main scanning direction. The heating elements selectively generate heat in accordance with the digital image signal subjected to various kinds of processing at the ADC board and a control board, not shown, following the ADC board. As a result, a thermoplastic resin film forming part of the stencil 61 is perforated, or cut, by heat. As a result, the image data are written to the stencil 61 in the form of a perforation pattern.

Another pair of feed rollers 94*a* and 94*b* convey the leading edge of the perforated stencil, i.e., a master 61*c*, toward the outer periphery of the print drum 101. A guide 96 steers the leading edge of the master 61*c* downward. A clamper 102 is mounted on the drum 101 and held in its open position. As a result, the master 61*c* hangs down toward the clamper 102. At this instant, the used master 61 has already been removed from the drum 101 by the master discharging step stated earlier.

The clamper 102 clamps the leading edge of the stencil 61*c* at a preselected timing. Then, the drum 101 starts rotating in the direction A (clockwise) while causing the stencil 61*c* to be sequentially wrapped therearound. The trailing edge of the master 61*c* is cut at a predetermined length by a cutter 95. The master feeding operation ends when the master 61*c* is fully wrapped around the drum 101.

A printing operation occurs after the above master feeding operation, as follows. The uppermost one of sheets 62 stacked on a tray 51 is fed toward a pair of registration rollers 113*a* and 113*b* in a direction X by a pick-up roller 111 and a pair of separator rollers 112*a* and 112*b*. The registration rollers 113*a* and 113*b* drive the sheet 62 to between the print drum 101 and a press roller 103 in synchronism with the rotation of the drum 101. The press roller 103 is movable into and out of contact with the outer periphery of the drum 101 by being driven by press roller moving means which will be described. When the press roller or pressing means 103 is brought into contact with the drum 101, it presses the sheet 62 brought to between the drum 101 and the press roller 103 against the drum 101 with the intermediary of the master 61*c*. The pressure acting on the drum 101 causes ink to ooze out through a porous portion forming a part of the drum 101. The ink causes the master 61*c* to tightly contact the drum 101 due to its viscosity. At the same time, the ink oozes out through the perforation pattern of the master 61*c*. As a result, the ink is transferred from the drum 101 to the sheet 62 via the master 61*c*, forming an image corresponding to the document image.

In the inside of the print drum 101, an ink distributor 123 feeds ink to an ink well 122 formed between an ink roller 120 and a doctor roller 121. The ink roller 120 is held in contact with the inner periphery of the drum 101 and rotated in the same direction as and in synchronism with the rotation of the drum 101. In this condition, the ink roller 120 feeds the ink to the inner periphery of the drum 101.

A sheet separator 114 peels off the sheet 62 carrying the image thereon from the drum 101. A conveyor belt 117 is passed over an inlet roller 115 and an outlet roller 116 and turned counterclockwise. The sheet 62 is conveyed by the belt 117 toward the sheet discharging section 55 located at the downstream side in the direction X while being retained on the belt 117 by a suction fan 118. Finally, the sheet 62 is driven out onto a tray 52 as a trial printing.

Figure 3:
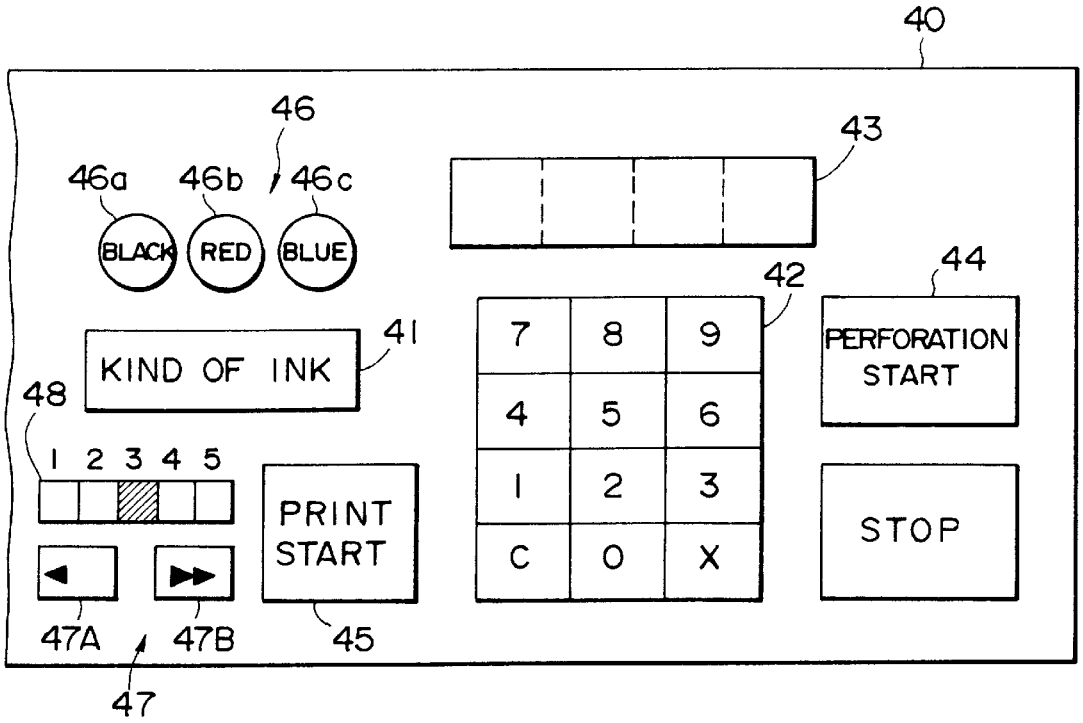
FIG. 3 is a plan view of an operation and display panel also included in the embodiment of FIG. 1.

If the trial printing is acceptable, the operator inputs a desired number of printings on numeral keys 42 arranged on the operation and display panel 40, FIG. 3, and then presses a print start key 45, FIG. 3. Then, the sheet feeding step, printing step and sheet discharging step described above are repeated to produce the desired number of printings.

Reference will be made to FIGS. 1–13 and 18 for describing an embodiment of the present invention. As shown in FIG. 1, a stencil printer embodying the present invention includes press roller moving means 22 for selectively moving the press roller 103 to a contact position where the roller 103 is pressed against the drum 101 or a non-contact position where the roller 103 is spaced from the drum 101. Pressure varying means 20 varies the pressure, or print pressure, of the press roller 103 acting on the drum 101. Viscosity sensing means 21 senses the viscosity of the ink. Kind-of-ink sensing means, which will be described with reference to FIG. 4, determines the kind of the ink used. Print speed setting means which will be described with reference to FIG. 3 allows a desired printing speed to be set. Control means 130 (see FIG. 7) selects a particular pressure out of a control pattern table on the basis of the ink viscosity sensed by the sensing means 21, the kind of the ink detected by the kind-of-ink sensing means, and the print speed set on the setting means. Then, the control means 130 controls the pressure varying means 20 such that the particular pressure acts on the drum 101.

Specifically, the press roller 103 has a metallic core and rubber or similar elastic material surrounding the core. The axis of the roller 103 is parallel to the axis of the drum 101. Shafts 103*a* protrude from the axially opposite ends of the core.

The press roller moving means 22 includes a horizontal shaft 3 substantially parallel to the shafts 103*a* and supported by the body frames 50 in such a manner as to be rotatable over a preselected angle. A right and a left arm 2*a* and 2*b* rotatably support the opposite ends of the shafts 103*a*. The arms 2*a* and 2*b* are each rotatable about the shaft 3 and supported at its base end by one end portion of the shaft 3. Therefore, the arms 2*a* and 2*b* are rotatable over the preselected angle together with the shaft 3. A stay 1 connects the portions of the arms 2*a* and 2*b* positioned at substantially the intermediate between the press roller 103 and the shaft 3. An up-down arm 4 is affixed to the intermediate portion of the shaft 3 at one end thereof. The up-down arm 4 has a bifurcated free end sandwiching the intermediate portion of the stay 1 while being spaced therefrom by small gaps. In this condition, the arm 4 transfers the rotation of the shaft 3 to the stay 1. An arm 5 has its one end affixed to one end of the shaft 3 outside of the left frame 50, so that the free end of the arm 5 is turnable about the shaft 3. A rotatable cam follower 5*a* is mounted on the arm 5. A tension coil spring 6 is anchored at one end thereof to the free end of the arm 5 and constantly biases the arm 5 in the direction in which the press roller 103 is pressed against the drum 101. A cam 18 is mounted on the left frame 50 via a rotatable cam shaft 18*a* and selectively engageable with the cam follower 5*a*. The gaps between the stay 1 and the up-down arm 4 allow the press roller 103 to be balanced in the right-and-left direction when the print pressure acts. In this sense, the press roller moving means 22 uses the principle of a balancing toy.

The stay 1 is formed of metal and provided with a hollow rectangular configuration, as illustrated. After the stay 1 has been inserted in the right and left arms 2*a* and 2*b*, a stop pin is fitted on each end of the stay 1 outside of the arm 2*a* or 2*b* in order to prevent the stay 1 from slipping out in the widthwise direction Y of the sheet.

The arm 5 is a triangular plate capable of selectively engaging with the contour of the cam 18 via the cam follower 5*a*. Stop pins, not shown, are press-fitted on the shaft 3 in order to affix the up-down arm 4 to the shaft 3.

Figure 2:
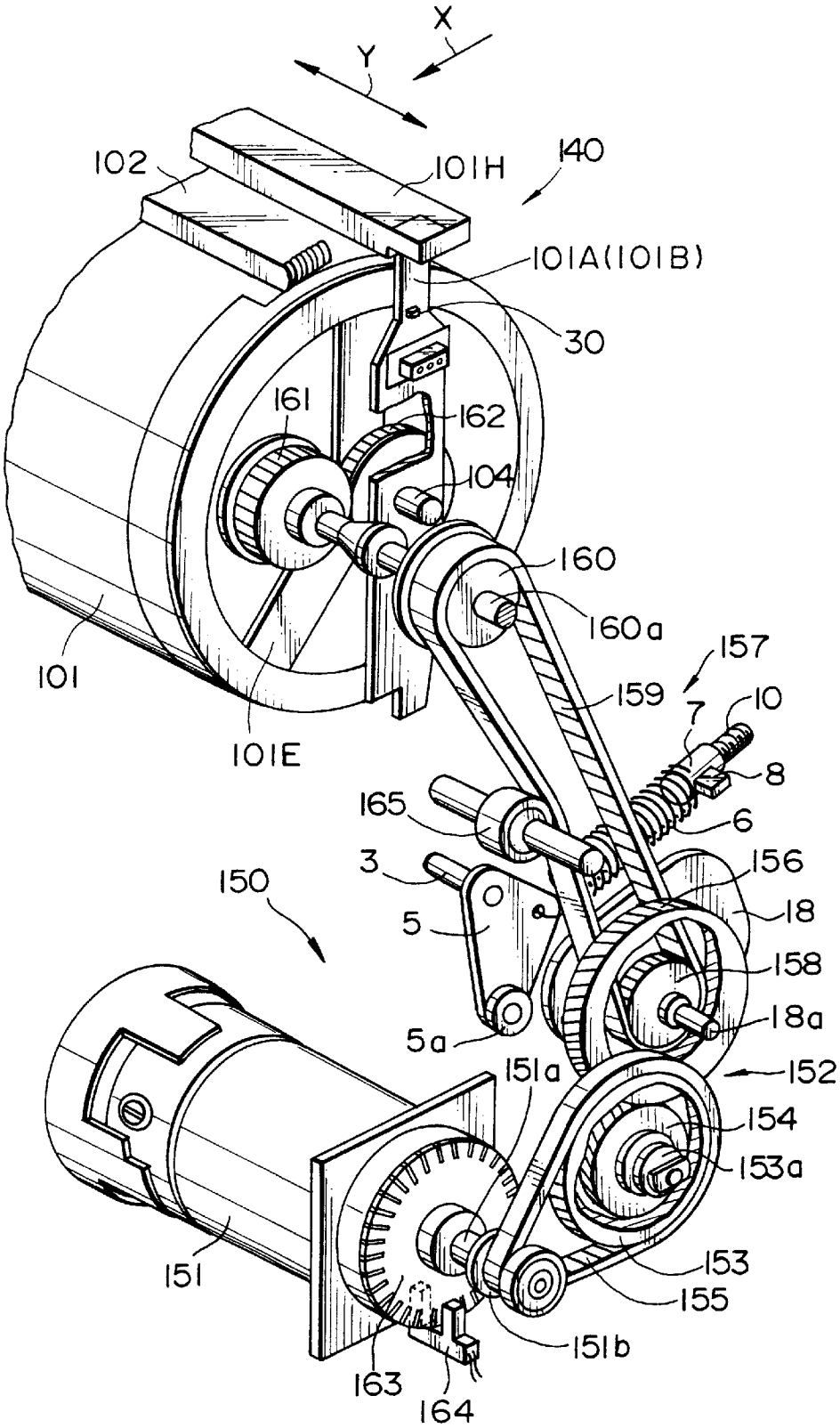
FIG. 2 is a perspective view showing press roller drive means included in the embodiment of FIG. 1.

As shown in FIG. 2, press roller drive means 150 cause the print drum 101 to rotate and move the press roller 103 between the contact position and the non-contact position in synchronism with the rotation of the drum 101. The drive means 150 includes a reversible main motor 151 mounted on the left frame 50. The main motor 151 is used to rotate the drum 101 and to move the press roller 103 between the above two positions. Speed reducing means 152 intervenes between the main motor 151 and the cam shaft 18*a*. Synchronizing means 157 intervenes between the drum 101 and the cam shaft 18*a*.

The speed reducing means 152 is made up of a toothed drive pulley 151*b*, a toothed driven pulley 153, a toothed belt 155 passed over the drive pulley 151*b* and driven pulley 153, a gear 154, and a gear 156 held in mesh with the gear 154, but greater in diameter than the gear 154. The drive pulley 151*b* is mounted on the output shaft 151*a* of the main motor 151. The driven pulley 153 is rotatably mounted on the frame body 50 via a shaft 153*a*. The gear, or smaller diameter gear, 154 is also mounted on the shaft 153*a*. The greater diameter gear 156 is mounted on the cam shaft 18*a*.

The synchronizing means 157 includes a toothed lower pulley 158 mounted on the cam shaft 18*a* between the cam 18 and the greater diameter gear 156. A toothed upper pulley 160 is rotatably supported by the left body frame 50 via a shaft 160*a*. A toothed main belt 159 is passed over the lower pulley 158 and upper pulley 160. A gear 161 is mounted o n one end of the shaft 160*a*.

The upper and lower pulleys 160 and 158 have the same diameter, and each has a toothed circumferential surface. The pulleys 160 and 158 are connected together by the main belt 159 and rotated at a ratio of 1:1. In the event of assemblage, the cam 18 is affixed to the cam shaft 18*a* while being synchronized to the drum 101, taking account of a printing range corresponding to the porous portion of the drum 101 and the previously mentioned contact position of the press roller 103. A shaft 104 extends between the left end of the drum 101 and a rear frame 101A which will be described later. A drum gear 162 is mounted on the shaft 104 and selectively engageable with the gear 161. The drum gear 162 and gear 161 have the same number of teeth.

A slit disk 163 is constituted by a conventional photorotary encoder and mounted on the output shaft 151*a* of the main motor 151. A sensor 164 is implemented by a photointerrupter and mounted on the left body frame 50 in the vicinity of the slit disk 163. The sensor 164 has two arms located at both sides of the disk 163; each arm is spaced from the disk 163 by a preselected distance. While the disk 163 is rotated together with the output shaft 151*a* of the main motor 151, the sensor 164 outputs pulses representative of the number of rotations of the drum 101. Therefore, the number of rotations of the drum 101 is controlled via the motor 151. A tension roller 165 is rotatably and movably mounted on the left body frame 50 in the vicinity of an intermediate point between the opposite ends of the main belt 159. The tension roller 165 is pressed against the intermediate portion of the belt 159.

The operation of the press roller drive means 150 will be briefly described for better understanding the description to follow. When the main motor 151 is driven, the driven pulley 153 and gears 154 and 156 are rotated via the drive pulley 151*b* and the belt 155 of the speed reducing means 152. At this instant, the rotation speed is sequentially reduced from the drive pulley 151*b* to the gear 156. The gear 156, in turn, rotates the cam 18 and the lower pulley 158 of the synchronizing means 157. Further, the main belt 159 causes the gear 161 and therefore the drum gear 162 to rotate. The rotation ratio between the pulleys 158 and 160 and the rotation ratio between the gears 161 and 162 are 1:1 each, as stated earlier. Therefore, the cam 18 and drum 101 rotate synchronously at a rotation ratio of 1:1. Consequently, the press roller drive means 150 causes the drum 101 to rotate, and at the same time causes the cam 18 to selectively contact the cam follower Sa at its greater diameter portion. This allows the press roller 103 to move to its contact position or non-contact position in synchronism with the rotation of the drum 101.

As shown in FIG. 1, the pressure varying means 20 includes a reversible pressure control motor 14 mounted on the left body frame 50 via a member, not shown. A worm 15 is mounted on the output shaft of the motor 14. The other end of the previously mentioned spring 6 is anchored to a movable hollow shaft 7. The shaft 7 is supported by the left frame 50 via a groove, not shown, formed in the left frame 50 such that the shaft 7 is movable back and forth only in the direction of sheet transport X. A female screw is formed in the inner periphery of the shaft 7. A male screw meshing with the female screw is formed on the outer periphery of a rotatable shaft 10. A worm wheel 11 is held in mesh with the worm 15. A rotation sensor in the form of an encoder 12 is mounted on one end of the shaft 10 and responsive to the number of rotations of the worm wheel 11. A pulse sensor 13 is mounted on the left body frame 50 via a member, not shown, and sandwiches the encoder 12 at a predetermined distance. An interrupting plate 8 extends out from the outer periphery of the shaft 7. A photosensor 9 is mounted on the left frame 50 via a member, not shown, and sandwiches the interrupting plate 8 at a predetermined distance. The photosensor 9 is responsive to the home position of the encoder 12 corresponding to the standard print pressure.

The encoder 12 is a conventional photoencoder having a slit disk. The encoder 12 and pulse sensor 13 cooperate to detect the number of rotations of the worm wheel 11, i.e., the distance which the shaft 7 moves in the direction X. Stated another way, the encoder 12 and pulse sensor 13 detect a change in the length of the spring 6.

Because the press roller moving means 22 and pressure varying means 20 have the above constructions, the opposite ends of the spring 6 are displaceably retained by the free end of the arm 5 and the shaft 7. In this condition, when the print pressure control motor 14 rotates in the forward or reverse direction, the amount of rotation of the motor 14 is transferred to the worm wheel 11 via the worm 15 and then transformed by the screw mechanism to the forward or rearward linear movement of the shaft 7 in the direction X.

The shaft 7 moving forward or rearward in the direction X varies the length, i.e., tension of the spring 6. As a result, the pressure of the press roller 103 acting on the drum 101 is varied. In the illustrative embodiment, the above pressure control begins at the home position of the encoder 12 at all times.

Figure 13:
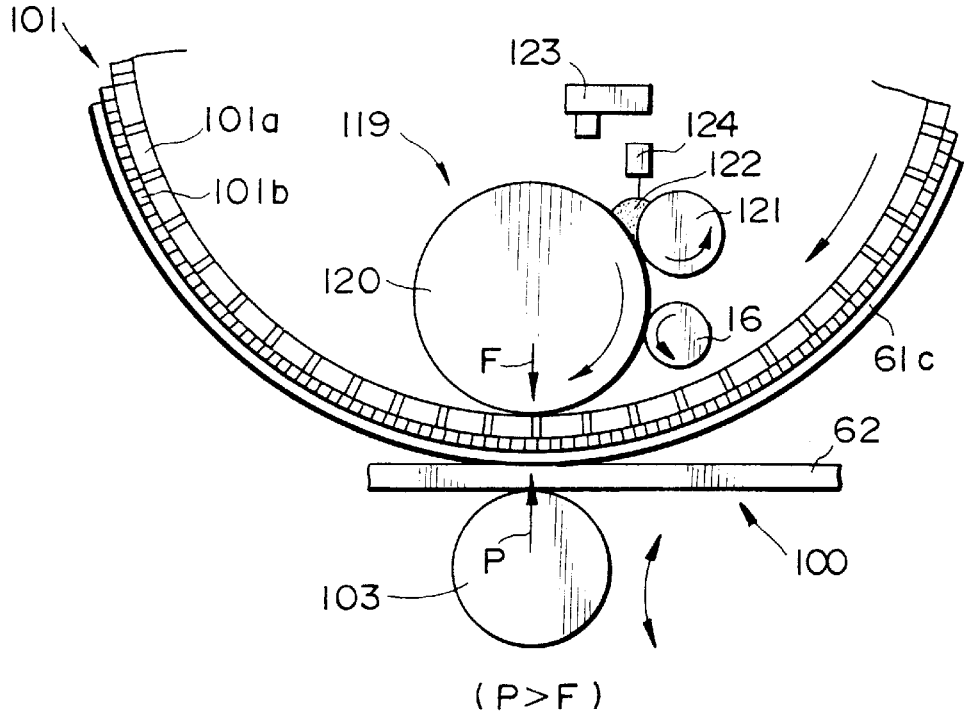
FIG. 13 is a partly sectional view showing a printing section included in the embodiment of FIG. 1 in a printing condition.

Referring to FIGS. 1, 2, 4, 13 and 18, the means for feeding the ink, the means for sensing the kind of the ink and the means for sensing the viscosity of the ink arranged around the ink drum 101 will be described in detail. The drum 101 extends in the axial direction of a shaft 104. As shown in FIG. 13, the drum 101 has a conventional laminate structure consisting of a hollow porous cylinder 111*a* formed of resin or metal, and a plurality of mesh screens 101*b* surrounding the hollow cylinder 101*a*. The cylinder 101*a* is made up of a printing portion where a number of fine apertures (no numeral) for passing the ink are formed, and a non-printing portion where such apertures are absent. The printing portion extends over a preselected circumferential range of the cylinder 101*a*. The non-printing portion extends also at the opposite edges of the drum 101 with respect to the axial direction of the shaft 104 over a preselected range each.

As shown in FIGS. 1, 13 and 18, ink feeding means 119 includes the previously mentioned ink roller 120 for feeding the ink to the inner periphery of the drum 101. The doctor roller 121 also mentioned earlier extends parallel to the in k roller 120 and is spaced from the roller 120 by a small gap. The ink well 122 having a wedge-like section is formed between the ink roller 120 and the doctor roller 121. The ink distributor 123 delivers the ink to the ink well 122. An ink amount sensor 124 is responsive to the amount of the ink existing in the ink well 122. Specifically, the sensor 124 senses the amount of the ink in terms of capacity with its needle dipped in the ink, as conventional. The sensor 124 is electrically connected to pressure variation control means 130, which will be described, via a drive control circuit as well as other circuits. In the drawings, the ink well 122 is indicated by aventurin pattern.

The arrangement around the ink feeding means 119 is substantially identical with the arrangement shown in, e.g., FIGS. 2 and 7 of Laid-Open Publication No. 5-229243 mentioned earlier. A pair of ink roller side walls, not shown, extend downward at the opposite ends of the shaft 104, and correspond to a pair of support plates 61*a* and 61*b* taught in the above Laid-Open Publication. The ink roller 120 and doctor roller 121 are each rotatably supported by the ink roller side walls.

The embodiment allows images of different colors, e.g., black, red, blue and yellow, to be printed one above the other. For this purpose, a drum unit which will be described is constructed to be easily replaceable. Assume that use is made of red ink Ak, blue ink Bk, and black ink Ck for printing a multicolor image. The inks Ak, Bk and Ck each name a particular fluidity, i.e., particular viscosity depending on, e.g., the composition and amount of a pigment, as discussed earlier.

Figure 4:
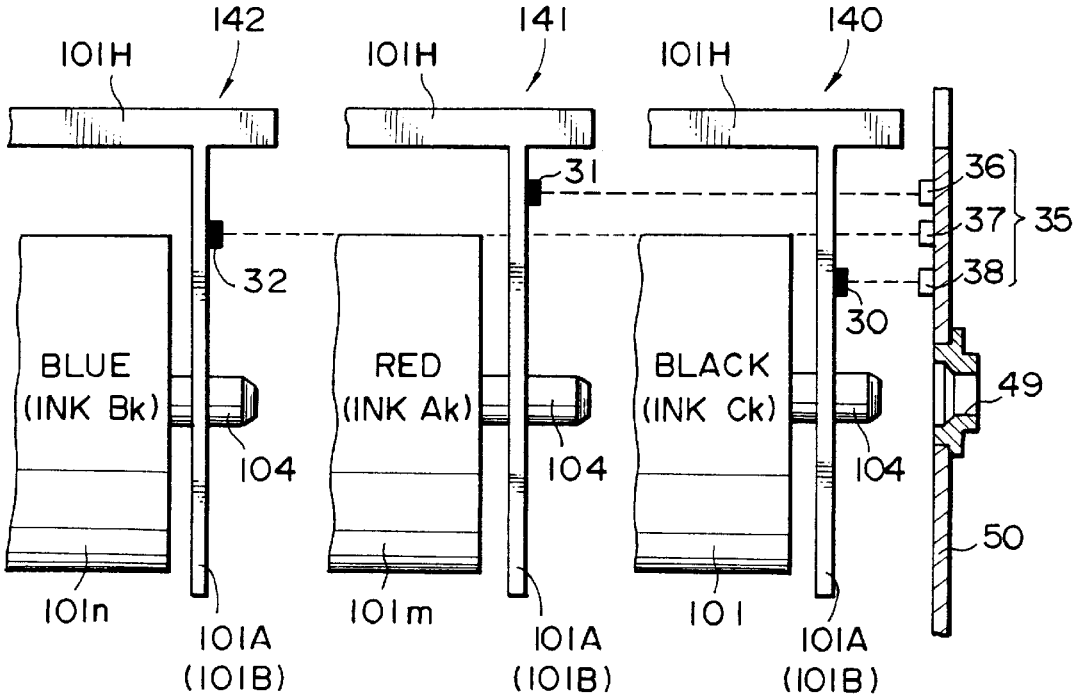
FIG. 4 is a section showing a drum unit sensor also included in the embodiment of FIG. 1.

As shown in FIG. 4, a drum unit 140 is used to print an image with the black ink Ck. The drum unit 140 has the print drum 101 accommodating the ink feeding means 119 for feeding the black ink Ck. The drum 101 is rotatably supported by the shaft 104. A front and a rear frame 101B and 101A rotatably support the drum 101 via the shaft 104. The frames 101A and 101B extend downward from the opposite ends of an elongate flat frame 101H. A small magnet 30 is located at a preselected position on the outer surface of the rear frame 101A, playing the role of kind-of-ink sensing means. A pump and a piping, not shown, are mounted on the outer surface of the front frame 101B in order to feed the ink Ck to the ink distributor 123.

Likewise, a drum unit 141 is used to print an image with the red ink Ak. The drum unit 141 is identical in construction with the drum unit 140 except for the following. Ink feeding means 119 is disposed in a print drum 101*m* for feeding the red ink Ak. A small magnet or kind-of-ink sensing means 31 is located at a preselected position on the outer surface of a rear frame 101A. An ink pump and a piping, not shown, are mounted on the outer surface of a front frame 101B in order to feed the red ink Ak to an ink distributor 123.

A drum unit 142 is used to print an image with the blue ink Bk and also identical in construction with the drum unit 140 except for the following. Ink feeding means 119 is disposed in a print drum 101*n* for feeding the blue ink Bk. A small magnet or kind-of-ink sensing means 32 is located at a preselected position on the outer surface of a rear frame 101A. An ink pump and a piping, not shown, are mounted on the outer surface of a front frame 101B in order to feed the blue ink Bk to an ink distributor 123.

The left body frame 50 is provided with a bearing portion 49 for removably supporting the shaft 104 of any one of the drum units 140–142, and holding means for removably holding the elongate frame 101H. A drum unit sensor 35 consists of three Hall element sensors 36, 37 and 38 mounted on the inner surface of the left body frame 50. The sensors 36–38 are positioned such that when one of the drum units 140–142 is mounted to the body frame 50, one of the sensors 36–38 aligns with one of the magnets 30–32 mounted on the drum unit. The drum unit sensor 35 and magnets 30–32 constitute the kind-of-ink sensing means of the illustrative embodiment. The Hall sensors 36–38 are connected to the pressure variation control means 130 by electronic circuitry, not shown.

The mechanism for allowing the drum units 140–142 to be selectively mounted to the printer body and including the holding means and bearing portion 49 is taught in, e.g., Laid-Open Publication No. 5-229243 mentioned earlier.

Assume that the drum unit 140 with the black ink Ck is mounted to the frame 50. Then, the magnet 30 faces the Hall element sensor 38, turning on the sensor 38. The resulting output of the sensor 38 shows that the drum unit 140 has been mounted to the printer body. This is also true with the other drum units 141 and 142 with the red ink Ak and blue ink Bk, respectively, except that their magnets 31 and 32 face the Hall element sensors 36 and 37, respectively. In this manner, the magnets are varied in position or number in accordance with the number of kinds of ink (colors of ink in the embodiment) to be used, while Hall element sensors are so arranged on the frame 50 as to face the magnets. This allows a greater number of kinds of ink to be sensed. It is to be noted that each ink stored in the respective drum unit is implemented by W/O type emulsion ink.

Figure 5:
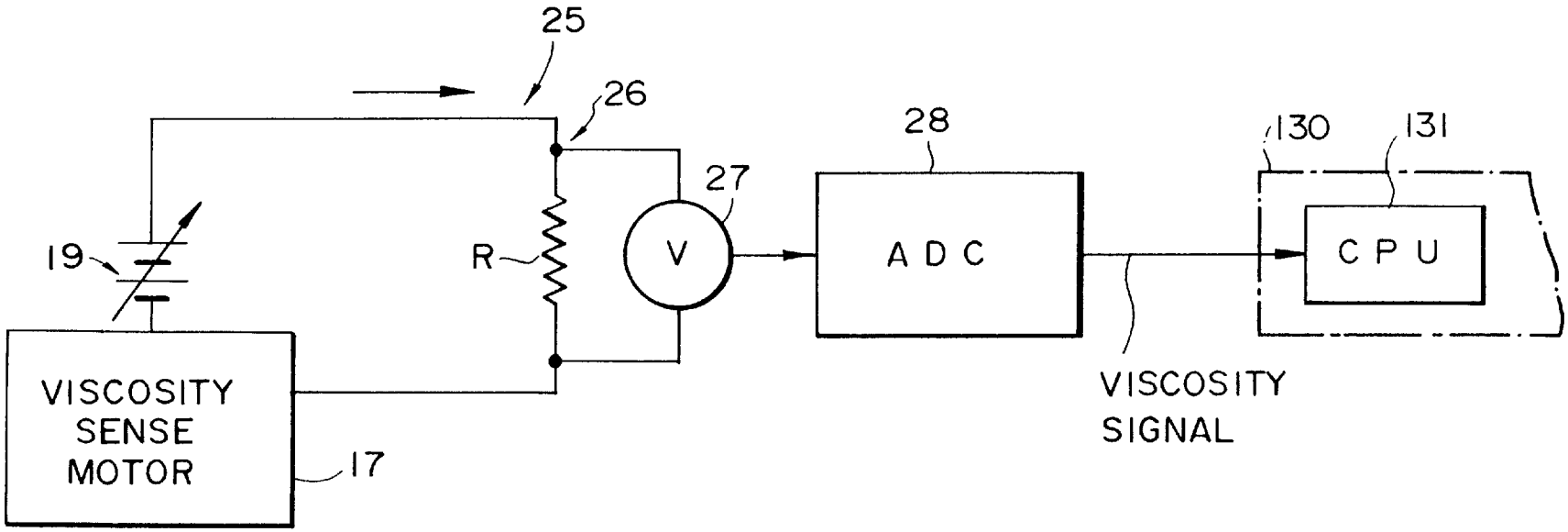
FIG. 5 is a block diagram schematically showing a part of viscosity sensing means also included in the embodiment of FIG. 1.
Figure 6:
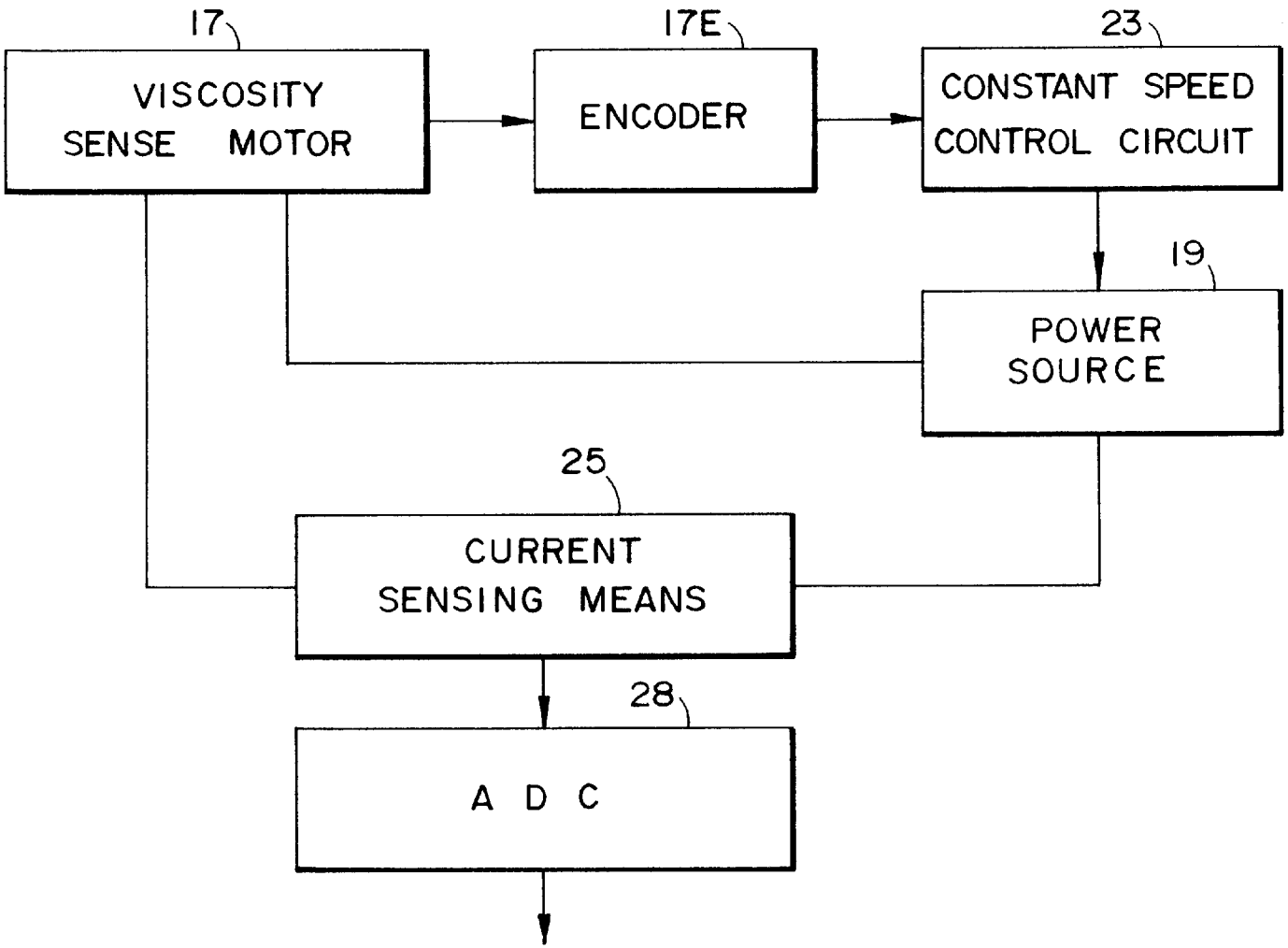
FIG. 6 is a block diagram schematically showing a constant speed control system for a viscosity sense motor also included in the embodiment FIG. 1.

As shown in FIGS. 1, 5 and 6, the viscosity sensing means 21 is made up of a viscosity sense roller 16, a viscosity sense motor 17, a power source 19, and current sensing means 25. The roller 16 is held in contact with, via an ink layer, the applying surface of the ink roller 120 disposed below the doctor roller 121. The motor or roller drive means 17 causes the roller 16 to rotate at a preselected speed. The power source 19 feeds power to the motor 17. The current sensing means 25 senses a current fed from the power source 19 to the motor 17.

As shown in FIG. 5, the viscosity sensing means 21 is characterized in that the viscosity of the ink is determined in terms of a current I to flow from the power source 19 to the motor 17.

The viscosity sense roller 16 has its periphery formed of aluminum or stainless steel or similar alloy. The entire axial periphery of the roller 16 is uniformly finished to have a surface roughness lying in a preselected range. More specifically, the roller 16 is held in contact with a part of the periphery of the ink roller 120 downstream of the gap between the ink roller 120 and the doctor roller 121 with respect to the direction of rotation of the roller 120. The roller 16 extends in parallel to and in the axial direction of the roller 120. One end of the roller 16 is connected to the output shaft 17*a* of the motor 17. The output shaft 17*a* is journalled to the left ink roller side wall mentioned earlier. The other end of the roller 16 is journalled to the right ink roller side wall also mentioned previously. The motor 17 causes the roller 16 to rotate in the same direction as the doctor roller 121.

The motor 17 is mounted on the outer surface of the left ink roller side wall and implemented as a DC motor. For the power source 19, use is made of a DC power source. As shown in FIG. 5, to detect a change in the current I being fed from the power source 19 to the motor 17, the power source 19 and motor 17 and a reference resistor R are arranged in a closed loop. The reference resistor R has a preselected resistance and plays the role of voltage transforming means 26. The power source 19, motor 17 and reference resistor R constitute a single DC circuit. Such a single DC circuit functions as a kind of meter for measuring the current I, and in this sense functions as the current sensing means 25.

A voltage sensor 27 is connected between the opposite ends of the reference resistor R in order to sense a voltage (V=IR) generated when the current I flows through the resistor R. In this configuration, the voltage sensor 27 reads a change in current I in terms of voltage, (V=IR). An analog-to-digital converter (ADC) 28 is connected to the voltage sensor 27 for transforming the analog voltage read by the sensor 27 to a corresponding digital viscosity signal. The ADC 28 is connected to a CPU (Central Processing Unit) 131 included in the pressure variation control means 130, as will be described later. The digital viscosity signal is sent from the ADC 28 to the CPU 131.

The DC circuit shown in FIG. 5 forms a part of drive circuitry for driving the motor 17. Of course, the DC circuit includes a thyristor or similar semiconductor switching device, not shown, for selectively turning on or turning off the current to be fed from the power source 19 to the motor 17 in response to a command signal output from the CPU 131.

FIG. 6 shows an arrangement for controlling the rotation speed of the motor 17 which causes the roller 16 to rotate at a constant speed. As shown, an encoder 17E is mounted on the output shaft 17*a* of the motor 17 for sensing irregularity in the rotation speed of the motor 17. A constant speed control circuit 23 controls, based on the output of the encoder 17E, the output current of the power source 19 such that the motor 17 rotates the roller 16 at a constant speed. The encoder 17E is accommodated in the motor 17 and implemented by a magnetic rotary encoder.

Assume that the encoder 17E has sensed an irregularity in the rotation speed of the motor 17 (deviation of the rotation speed of the roller 16 from a preselected speed). Then, in response to the output of the encoder 17E, the control circuit 23 controls the output current of the power source 19 in the above-described manner. With this feedback circuitry, it is possible to cause the roller 16 to rotate at a constant speed via the motor 17.

Specifically, when the ink viscosity is low, the load (torque) acting on the roller 16 contacting the ink roller 120 decreases, increasing the rotation speed of the motor 17. Then, the output current (voltage) of the power source 19 is reduced in order to correct the rotation speed of the motor 17. Conversely, when the ink viscosity is high, the torque acting on the roller 16 increases with the result that the rotation speed of the motor 17 decreases. In this case, the output current (voltage) of the power source 19 is increased in order to correct the rotation speed of the motor 17. Therefore, a change in ink viscosity can be determined on the basis of a change in the output current (voltage) of the power source 19.

Figure 14:
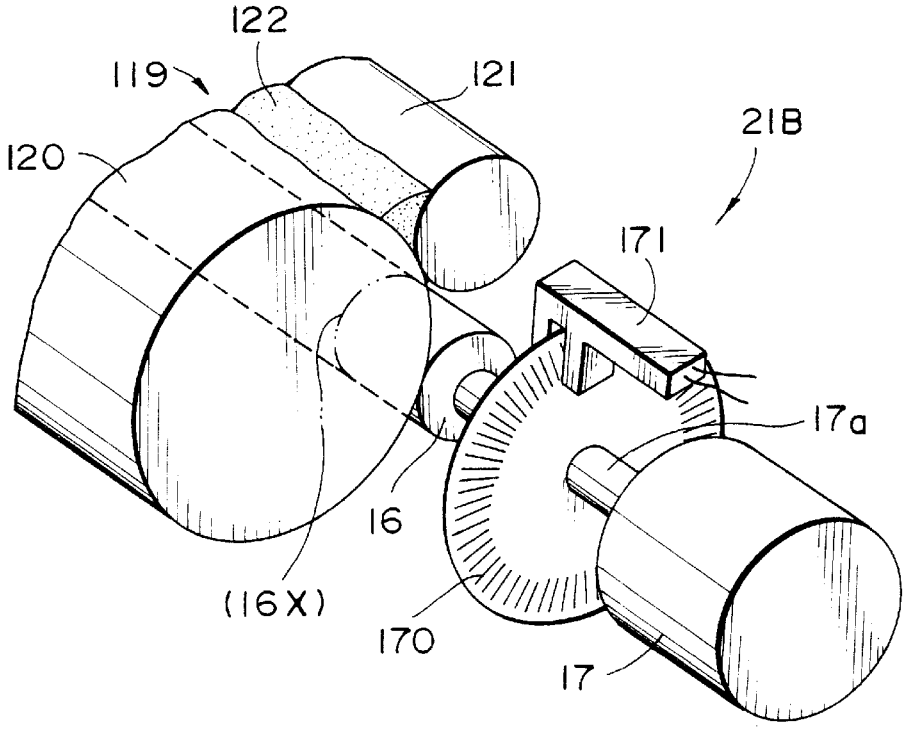
FIG. 14 is a fragmentary enlarged view showing viscosity sensing means included in an alternative embodiment of the present invention.

As shown in FIG. 14, the encoder 17E may be replaced with a conventional arrangement including a rotation number sensor 170 and a pulse sensor 171. The rotation number sensor 170 is a photo-rotary encoder having a slit disk. The pulse sensor 171 sandwiches the slit disk. In such an alternative arrangement, the sensors 170 and 171 cooperate to sense the number of rotations of the motor 17. The rotation speed of the motor 17 is controlled with the number of rotations being fed back to the CPU 131 at an adequate timing.

The control over the rotation speed of the motor 17 described above is only illustrative. If the advantages of the constant speed control discussed above are not necessary, use may, of course, be made of a conventional electronic governor or tachometer generator by way of example.

Figure 11:
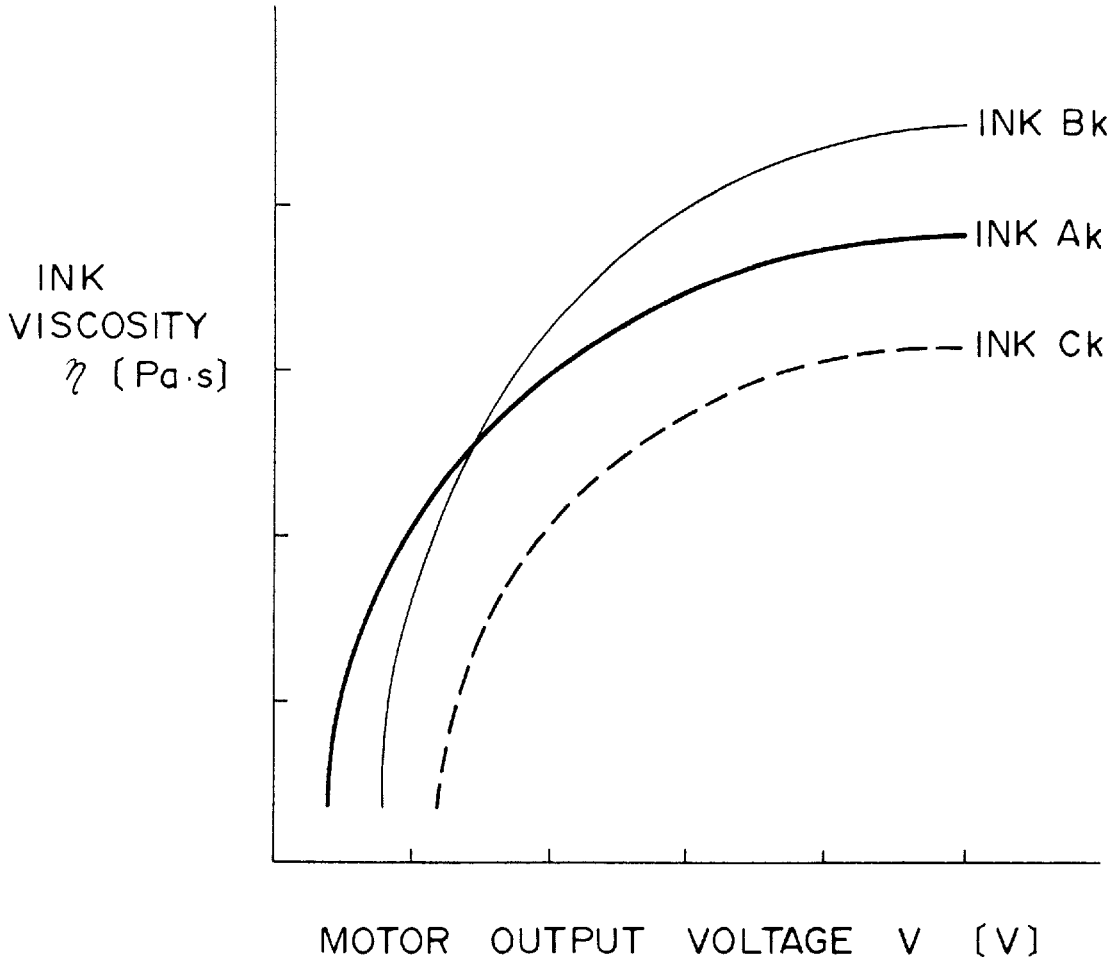
FIG. 11 is a graph showing a relation between the viscosity of ink and the output voltage of the viscosity sense motor.

FIG. 11 shows a relation between the ink viscosity and the output voltage of the motor 17 as determined with the red ink Ak, blue ink Bk and black ink Ck by way of example. In FIG. 11, the motor output voltage is representative of the viscosity signal described with reference to FIG. 7. The ordinate and abscissa respectively indicate the ink viscosity η[Pa.s] and the motor output voltage V [V] detected by the voltage sensor 27. The viscosity is measured ink by ink b y use of a cone plate type viscometer (available from HAAKE) at a shear rate of 100 [1/s]. As for the shear rate, an optimal value should only be selected by experiments in accordance with the configuration of the viscosity sensing means built in the stencil printer. Data representative of a relation between the ink viscosity and the motor output voltage was produced at an ambient temperature of 23° C. and relative humidity of 65% by way of example, as follows. First, the viscosity of any one of the above ink was measured by the viscometer. Then, a sample of the ink was set in a stencil printer based on the illustrative embodiment and also held at the above ambient conditions. In this condition, the motor 17 was operated in accordance with a specific routine which will be described, while the motor output voltage V was measured. As a result, the data shown in FIG. 11 were obtained ink by ink.

As FIG. 11 indicates, the ink viscosity η and motor output voltage V are substantially proportional to each other. Of course, for the measurement, all the drum units 140–142 were provided with the ink feeding means 119, rollers 16, motors 17 and so forth exactly the same in specifications including dimensions, positions, and so forth.

In practice, constantly holding a preselected amount of ink in the ink well 122 appears to be difficult so far as the state-of-the-art technologies are concerned. In the illustrative embodiment, after the ink on the ink roller 120 has been regulated to a preselected thickness by the doctor roller 121, the viscosity sense roller 16 senses the viscosity of the ink at a position as close to the inner periphery of the drum 101 as possible.

FIG. 3 shows the operation and display panel 40 positioned above the image reading section 80 and including the following various keys. A kind-of-ink set key 41 serves as kind-of-ink setting means, but it is not used in this embodiment. The numeral keys 42 mentioned earlier allow the operator to input, e.g., a desired number of printings. A seven-segment LED (Light Emitting Diode) display 43 displays, e.g., the number of prints input on the numeral keys 42. The perforation start key 44 is pressed to start the procedure from the image reading to the trial printing. The print start key 45 is pressed to start the operation for outputting the desired number of printings and the rotation of the viscosity sense motor 17. A group of LEDs 46 indicate the kind of ink selectively input on the kind-of-ink set key 41, or the kind of ink sensed by the drum unit sensor 35. A speed-down key 47A and a speed-up key 47B constitute print speed setting means for allowing the operator to select one of five consecutive levels of print speeds, i.e., levels 1–5. The two keys 47A and 47B are labeled 47 collectively. A speed display 48 displays the print speed selected on the speed down key 47A or the speed-up key 47B, and is implemented by a groups of LEDs.

In the group of LEDs 46, an LED 46*a* turns on when the drum unit 140 with the black ink Ck is selected while an LED 46*b* turns on when the drum unit 141 with the red ink Ak is selected. Further, an LED 46*c* shows that the drum unit 142 with the blue ink Bk is selected. When the kind-of-ink set key 41 is set once, the LED 46*a* turns on, or when it is set twice, the LED 46*b* turns on. In this manner, every time the key 41 is pressed, the LED that turns on is sequentially shifted. This successfully informs the operator of the selection of the drum unit matching the desired kind of ink.

The speed display 48 sequentially turns on its LEDs representative of the five levels of print speeds, or first to fifth speeds as sometimes referred to, every time the operator presses the speed-down key 47A or the speed-up key 47B. The operator can therefore confirm the print speed on the speed display 48 by eye.

The third print speed indicated by hatching in FIG. 3 is representative of a standard or usual print speed and is automatically set up if the operator does not press either the speed-down key 47A or the speed-up key 47B. Assume that the first print speed is lowest and corresponds to sixty printings per minute (60 rpm), that the second print speed corresponds to seventy-five printings per minute (75 rpm), that the third print speed corresponds to ninety printings per minute (90 rpm), that the fourth print speed corresponds to 105 printings per minute (105 rpm), and that the fifth print speed corresponds to 120 printings per minute (120 rpm).

A reference will be made to FIGS. 5–7 for describing the control arrangement and control process in detail. As shown in FIG. 7, the pressure variation control means 130 includes an I/O (Input/Output) port, not shown, a ROM (Read Only memory) 132, and a RAM (Random Access Memory) 133 in addition to the CPU 131. These constituents are constructed into a microcomputer connected by a signal bus. The control means 130 is mounted on a board, not shown, mounted on the left body frame 50. In FIG. 7, blocks indicated by phantom lines are not used in this embodiment.

The above control means 130 selects a particular pressure out of a control pattern table in accordance with the ink viscosity sensed by the viscosity sensing means 21, the kind of ink sensed by the drum unit sensor 35, and the print speed set on the print speed set key or print speed setting means 47. Then, the control means 130 controls the pressure varying means 20 such that the pressure selected acts on the print drum 101.

The CPU 131 is electrically connected to the keys on the panel 140, the LEDs 46, speed display 48, drum unit sensor 35, ADC 28, pressure control motor 14 and pulse sensor 13 via the I/O port so as to interchange various kinds of signals therewith. Further, the CPU 131 is electrically connected to the document reading section 80, master making and feeding section 90, master discharging section 70, sheet feeding section 110, pressing section 100, and sheet discharging section 55 via drivers assigned thereto, interchanging various kinds of signals therewith. The CPU 131 controls the entire printing system including the start, stop and timing of the drive mechanisms of the above various sections.

Figure 12:
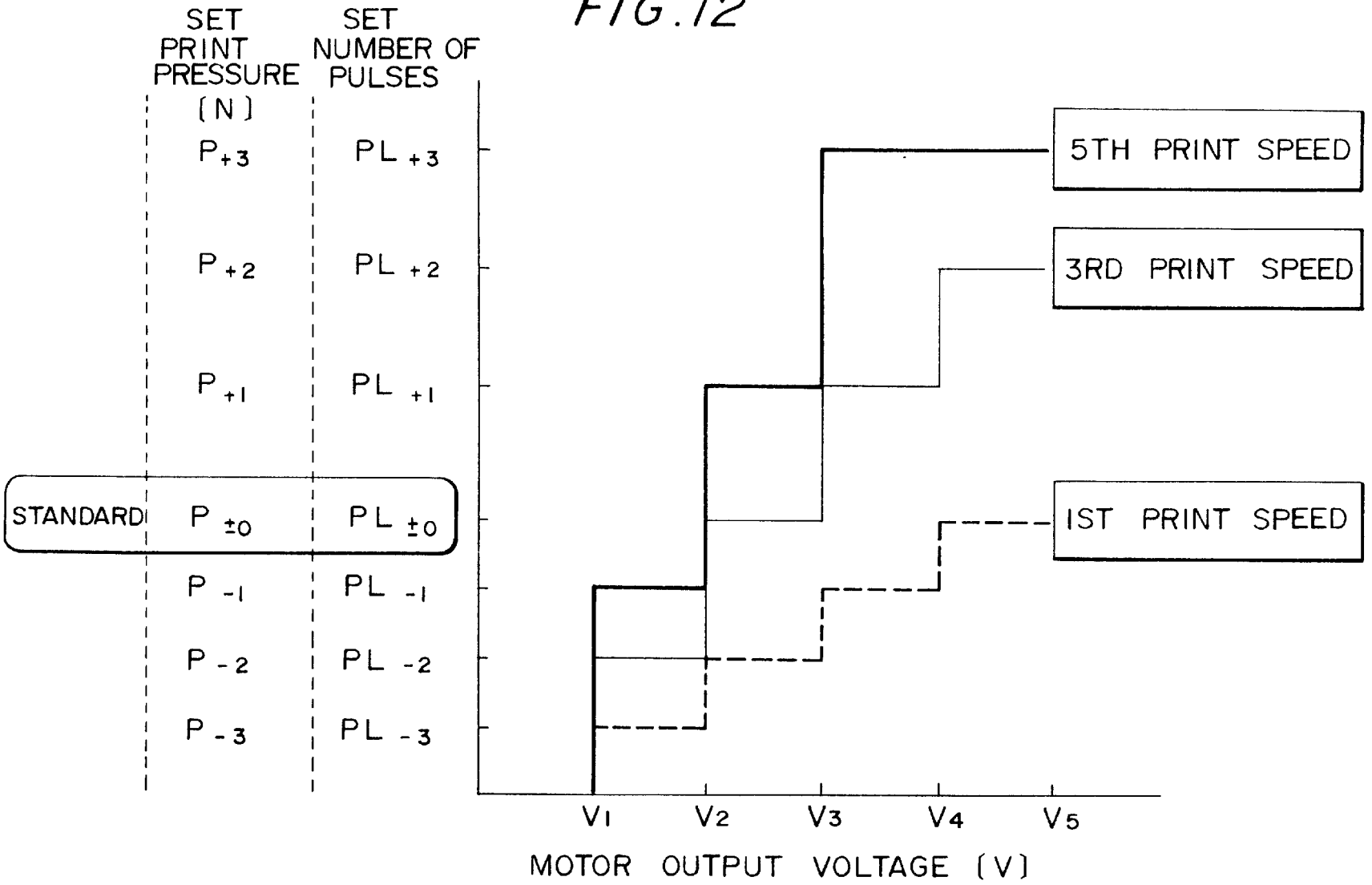
FIG. 12 is a graph representative of a control pattern table for setting a print pressure and particular to the embodiment of FIG. 1.

The control pattern table is stored in the ROM 132 and determined by, e.g., experiments beforehand. A particular control pattern table is prepared for each kind of ink. FIG. 12 shows a specific control pattern table assigned to the black ink Ck by way of example. As shown, the abscissa indicates a motor output voltage [V] while the ordinate indicates a set pressure [N] optimal for the instantaneous machine condition and a set number of pulses corresponding to the set pressure. The first, third and fifth print speeds sequentially stepping up each are preset in conformity to the above parameters. That is, the table shows that a preselected pressure, i.e., a set number of pulses corresponding to a set pressure [N] optimal for the instantaneous machine condition, is selected by using the motor output voltage [V] representative of the viscosity of the black ink Ck and the set print speed as parameters, i.e., in accordance with the viscosity signal and print speed set signal.

Also stored in the ROM 132 are a program relating to the operation of the various sections, a program for executing the above function of the pressure variation control means 130 (flowcharts shown in FIGS. 8–10), and necessary fixed data. It is to be noted that the first, third and fifth print speeds shown in FIG. 12 simply represent the various speeds available with the embodiment; the second and fourth speeds are omitted to better understand the operation of the embodiment.

The RAM 133 stores the temporary results of computation effected by the CPU 131 as well as the outputs of the various keys and sensors described previously, thereby allowing set parameters to be input and output.

A perforation start signal from the perforation start key 44, a print start signal from the print start key 45, a print number set signal from the numeral keys 42 and print speed set signals from the print speed set keys 47 (data signals and ON/OFF signals) are sent to the CPU 131 via the I/O port. The CPU 131 sends, in response to the print speed set signals, a speed display signal (ON/OFF signal) to the speed display 48 via the I/O port and a driver, not shown, causing the LED assigned to the set print speed to turn on. At the same time, the CPU 131 writes the print speed set signals in the RAM 133.

The output of the drum unit sensor 35, i.e., a kind-of-ink signal (ON/OFF signal), is sent to the CPU 131 via the I/O port. In response, the CPU 131 sends a display signal to the LEDs 46 via the I/O port and a driver, not shown, causing the LED designated by the kind-of-ink signal to turn on. At the same time, the CPU 131 writes the kind-of-ink signal in the RAM 133.

The viscosity signal digitized by the ADC 28 as stated earlier with reference to FIGS. 5 and 6 is sent to the CPU 131 via the I/O port. The CPU 131 compares the kind of ink, print speed and ink viscosity represented by the above signals with the control pattern table stored in the ROM 132. As a result, the CPU 131 selects a set number of pulses corresponding to a set pressure [N] optimal for a preselected pressure, i.e., the instantaneous machine condition. Then, the CPU 131 sends a pressure control signal representative of the above set number of pulses to the pressure control motor 14 via the I/O port and the driver, not shown, so that the print pressure is optimally controlled.

Figure 8:
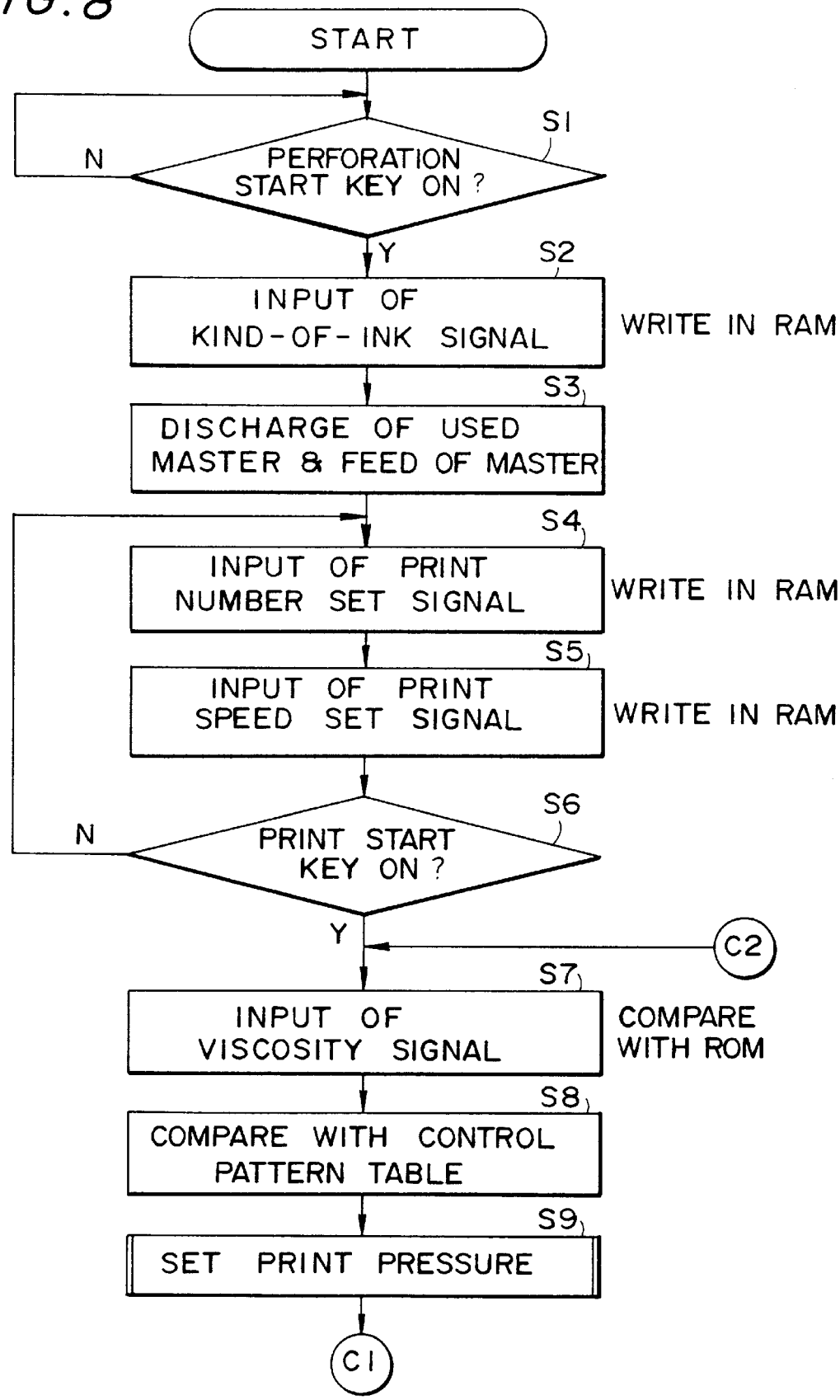
FIG. 8 is a flowchart demonstrating a specific operation of the embodiment of FIG. 1.
Figure 9:
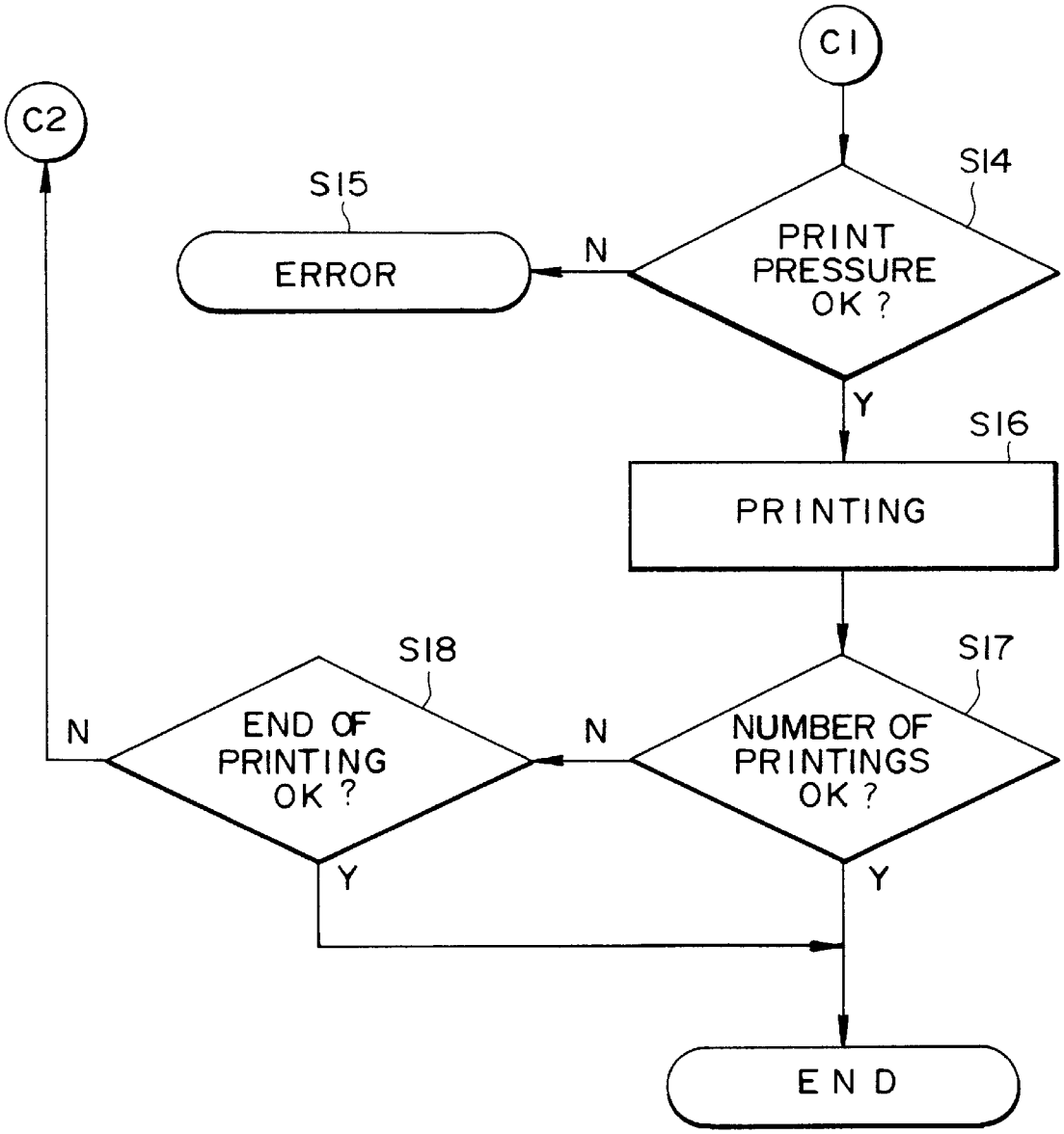
FIG. 9 is a flowchart demonstrating a procedure following the steps shown in FIG. 8.
Figure 10:
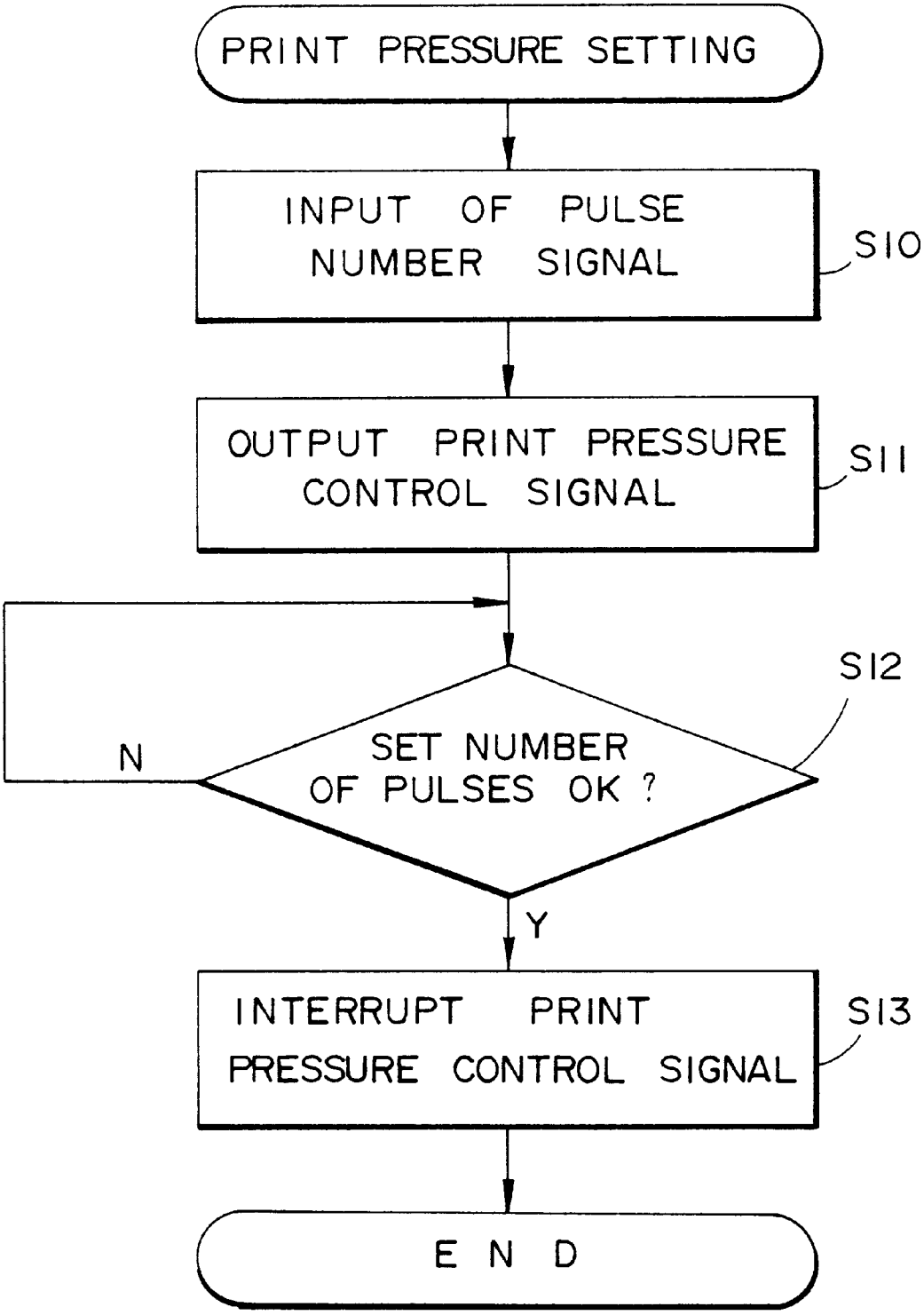
FIG. 10 is a flow chart showing a print pressure setting procedure included in the operation of FIG. 8 in detail.

Referring to FIGS. 8–10, the operation of the illustrative embodiment, mainly the difference thereof from the operation of the printer shown in FIG. 18, will be described. First, the operator sets the document 60 on the glass platen, and then presses (ON) the perforation start key 44. The resulting perforation start signal is fed to the CPU 131 via the I/O port.

In response, the CPU 131 determines the kind of the ink stored in the drum unit 140. Specifically, the Hall element sensor 38 faces the magnet 30 of the drum unit 140 and turns on to output a kind-of-ink signal. On receiving the kind-of-ink signal via the 110 port, the CPU 131 writes it in the RAM 133 as one of the conditions for pressure control. At this instant, the operator is informed of the selection of the drum unit 140 because the LED 46*a* turns on. This is followed by the procedure beginning with the reading of the document 60 and ending with the trial printing (steps S1–S3).

Assume that after the trial printing, the operator inputs a desired number of printings on the numeral keys 42, and then selects the fifth print speed on the speed-up key 47B. Then, a print number set signal and a print speed set signal are sequentially sent to the CPU 131 via the I/O port. The CPU 131 writes such signals in the RAM 133 as other pressure control conditions. Then, the CPU 131 causes the LED display 43 to display the input number of printings and causes one of the LEDs of the speed display 48 assigned to the fifth print speed to turn on (steps S4 and S5).

When the operator presses the print start key 45 (YES, step S6), the print start signal is sent to the CPU 131 via the I/O port. In response, the CPU 131 causes the print drum 101 to rotate in the direction A while causing the ink roller 120 to rotate in the same direction. The ink amount sensor 124 senses the amount of ink existing in the well 122. In response to the output of the sensor 124, the ink feed pump is operated to feed the ink Ck via the distributor 123 until the ink Ck reaches a preselected amount. When the ink Ck in the ink well 122 reaches the preselected amount, the viscosity sense motor 17 is rotated at a constant speed in the same direction as the doctor roller 121.

The current I to flow from the power source 19 to the viscosity sense motor 17 is increased or decreased for correcting the rotation speed of the motor 17, as stated with reference to FIGS. 5 and 6. The voltage transforming means 26 of the current sensing means 25 transforms such a current I to a voltage. The voltage output from the transforming means 26 is sensed by the voltage sensor 27, digitized by the ADC 28, and then sent to the CPU 131 via the I/O port as a viscosity signal (step S7).

In response to the viscosity signal, the CPU 131 reads the kind-of-ink signal stored in the RAM 133 and compares it with the color-by-color control pattern tables stored in the ROM 132 (step S8). First, the CPU 131 selects the control pattern table assigned to the ink Ck and shown in FIG. 12. Then, the CPU 131 compares the above viscosity signal (motor output voltage in this embodiment) and the print speed set signal (fifth speed) also read out of the RAM 133 with the table shown in FIG. 12. As a result, the CPU 131 selects a set number of pulses corresponding to a set print pressure optimal for the instantaneous machine condition.

For example, when the motor output voltage represented by the viscosity signal is higher than $V_2$ inclusive, but lower than $V_3$, the CPU 131 selects a print pressure of $P_{+1}$ [N] optimal for the instantaneous machine condition in accordance with the fifth print speed which is indicated by a bold line in FIG. 12. Consequently, the CPU 131 selects a number of pulses of $PL_{+1}$ corresponding to the print pressure $P_{+1}$ [N]. When the motor output voltage V is higher than $V_3$ inclusive, the CPU 131 selects a set print pressure of $P_{+3}$ [N], and therefore a set number of pulses $PL_{+3}$.

Subsequently, a step S9 is executed for setting the print pressure. Specifically, as shown in FIG. 10, the interrupting plate 8 and photosensor 9 cooperate to sense the home position of the encoder 12 (standard print pressure), so that a pulse number signal corresponding to the standard print pressure is input to the CPU 131 (step S10). In response, the CPU 131 sends a print pressure control signal (command signal) for causing the motor 14 to rotate the encoder 12 by the above number of pulses to the motor 14 via the I/O port and driver. The motor 14 rotates in the forward or reverse direction until the encoder 12 reaches the preselected number of pulses (encoder pulses). At the same time, the encoder 12 and pulse sensor 13 cooperate to send the number of rotations of the encoder 12, i.e., a change in the length of the spring 6 to the CPU 131 as a pulse number signal, allowing the CPU 131 to execute the feedback control. When the pulse number signal output from the sensor 13 coincides with the preselected number of pulses, the CPU 131 stops sending the print pressure control signal and thereby causes the motor 14 to stop rotating (steps S11–S13).

The change in the length of the spring 6 corresponding to the set number of pulses (encoder pulses) causes the tension of the spring 6 to vary. As a result, the print pressure control stated above is executed via the press roller moving means 22. Then, the CPU 131 determines whether or not the print pressure setting routine is successful (step S14). For this decision, the tension or length of the spring 6 may be actually measured. This, however, needs a complicated construction and increases the cost. In light of this, in the embodiment, the decision is made simply on the basis of the presence/absence of the interrupting plate 8. If the answer of the step S14 is positive (YES), the usual printing operation is repeated a number of times corresponding to the desired number of printings input on the numeral keys 42, and the routine ends (steps S16–S18).

Reference will be made to FIG. 13 for describing printing conditions for implementing optimal image quality. In the stencil printer shown and described, the amount of ink to be forced out via the perforations of the master 61*c* is effected by a pressure F acting between the ink roller 120 and the porous cylinder 101*a* of the print drum 101 (ink discharge pressure F). The ink discharge pressure F is not a print pressure P which the press roller 103 (or a press drum 125 which will be described) exerts when pressed against the drum 101 by the press roller moving means 22 and pressure varying means 20. The pressure F is a value produced by subtracting the pressure deforming the drum 101 and causing it to contact the ink roller 120 from the print pressure P. Therefore, the pressure F actually acting on the ink is lower than the print pressure P (P>F). It follows that the optimal image quality is achievable if the rigidity of the print drum 101 and the print pressure P of the press roller 103 are so balanced as to optimize the pressure F.

In a microscopic sense, the ink must be pressed into the irregular surface of the sheet 62 and further infiltrated into the fibers of the sheet 62. In this respect, not only the above ink discharge pressure F forcing out the ink from the inside of the print drum 101, but also the print pressure P urging the sheet 62 against the master 61*c* are the essential factors to be controlled for realizing the optimal image quality. It has been customary to so design the rigidity of the drum 101 as to set up the necessary print pressure P and ink discharge pressure F because sufficient control over the print pressure P has not been practical.

Figure 16:
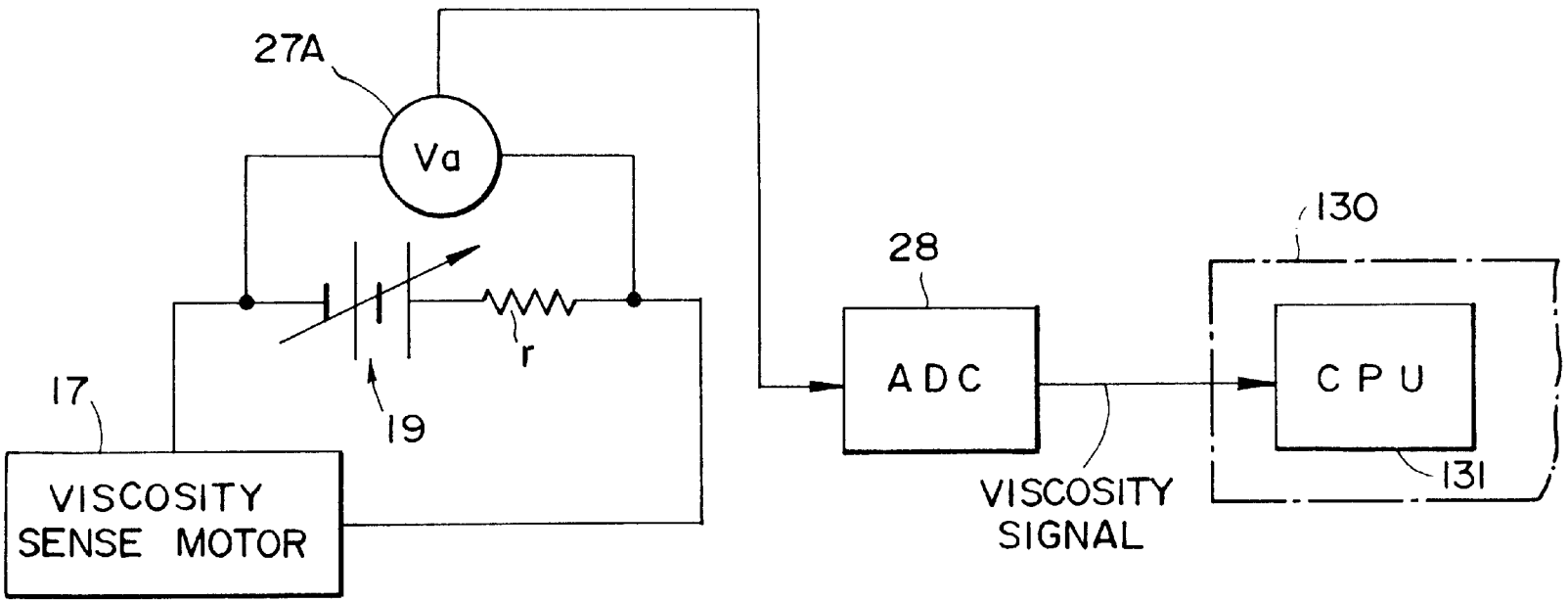
FIG. 16 is a block diagram schematically showing a part of viscosity sensing means included in a modification of the embodiment shown in FIG. 1.
Figure 17:
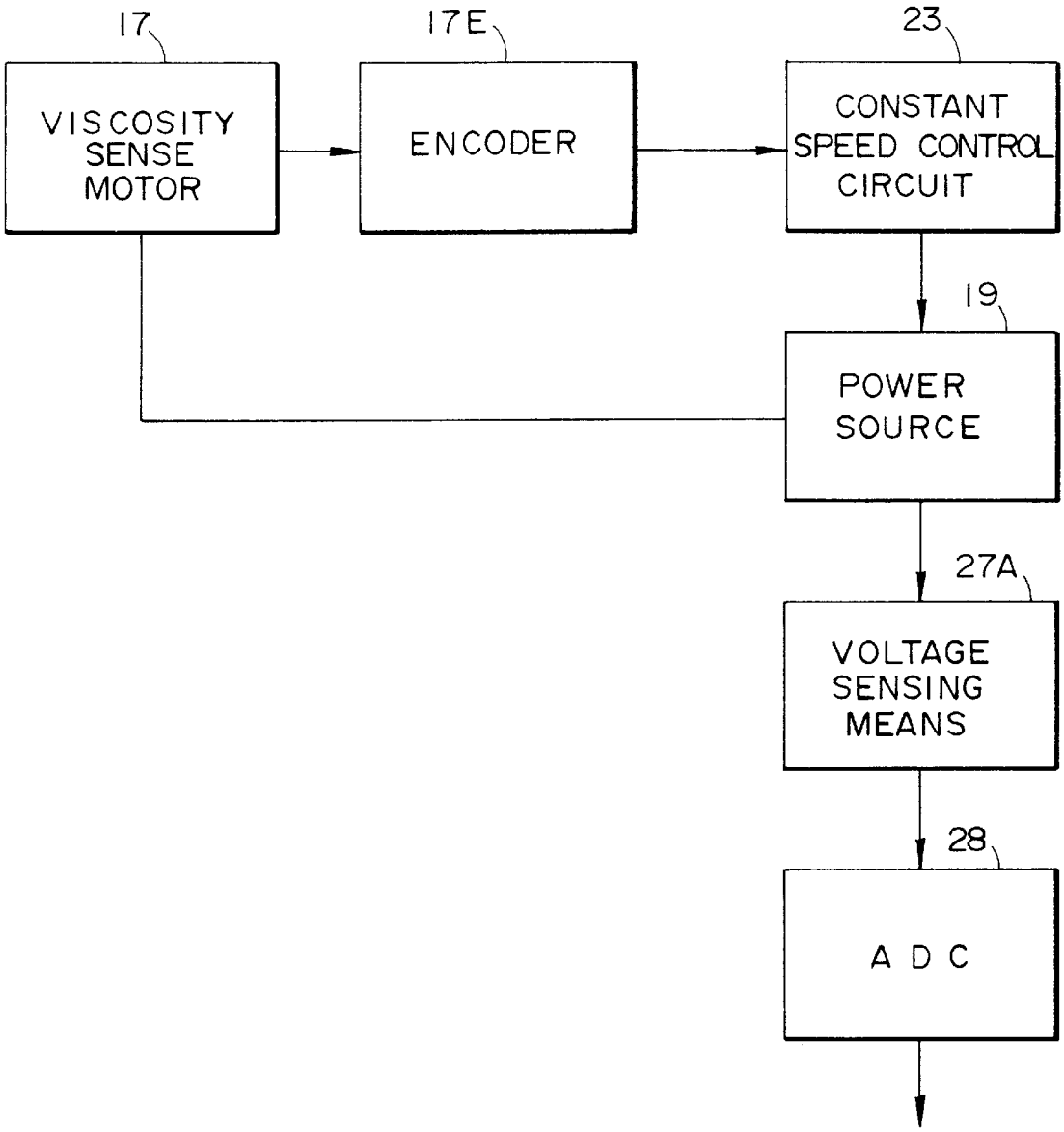
FIG. 17 is a block diagram schematically showing a constant speed control system for a viscosity sense motor included in the modification.

A modification of the above embodiment will be described with reference to FIGS. 1, 16 and 17. The modification is identical with the embodiment except that it has viscosity sensing means 21A in place of the viscosity sensing means 21. As shown, the means 21A is different from the means 21 in that the current sensing means 25 for sensing the current I is absent, and in that voltage sensing means 27A for sensing the voltage of the power source 19 is added. The circuitry shown in FIG. 16 has a resistor r included in the power source 19.

In the modification, the viscosity sensing means 21A detects a change in the voltage V being applied from the power source 19 to the viscosity sense motor 17. The output of the sensing means 21A is representative of ink viscosity. The rest of the construction of the modification will not be described in order to avoid redundancy.

Referring to FIGS. 1, 7, 14, 19 and 20, an alternative embodiment of the present invention will be described. This embodiment is different from the previous embodiment only in that viscosity sensing means 21B is substituted for the viscosity sensing means 21. The means 21B is identical with the means 21 except that the current sensing means 25, ADC 28 and power source 19, FIG. 7, are omitted, and in that a rotation number sensor (encoder hereinafter) 170, a pulse sensor 171 and a constant current power source 19A are added which are indicated by phantom lines.

The viscosity sensing means 21B has the constant current power source 19A, encoder 170 and pulse sensor 171 in addition to the previously stated viscosity sense roller 16 and viscosity sense motor or roller drive means 17. The constant current power source 19A outputs a constant current for causing the motor 17 to rotate with a constant torque. The encoder 170 and pulse sensor 171 constitute roller speed sensing means responsive to the rotation speed of the roller 16. The viscosity sensing means 21B therefore senses the viscosity of ink on the basis of a change in the rotation speed of the roller 16.

The encoder 170 is an optical rotary encoder having a slit disk mounted on the output shaft 17*a* of the motor 17 coaxially with the roller 16. The pulse sensor 171 is a photointerrupter type optical sensor sandwiching the slit disk at a preselected distance, and plays the role of a pulse generator. The CPU 131 determines ink viscosity on the basis of a change in the pulses output from the sensor 171, i.e., a pulse number signal higher in accuracy than the viscosity signal of the previous embodiment.

The operation of the alternative embodiment, mainly the difference thereof from the operation of the previous embodiment, will be described. As shown in FIG. 7, a constant current is fed from the constant current power source 19A to the motor 17 at all times, causing the motor 17 to rotate with a constant torque. The rotation speed of the motor 17 varies in accordance with the load ascribable to the difference in ink viscosity. A change in the rotation speed of the motor 17 results in a change in the number of pulses output from the cooperative encoder 170 and sensor 171. Stated another way, the width (frequency) of the pulses output from the cooperative encoder 170 and sensor 171 varies, allowing a change of ink viscosity to be determined. The resulting pulse number signal is sent to the CPU 131.

Figure 19:
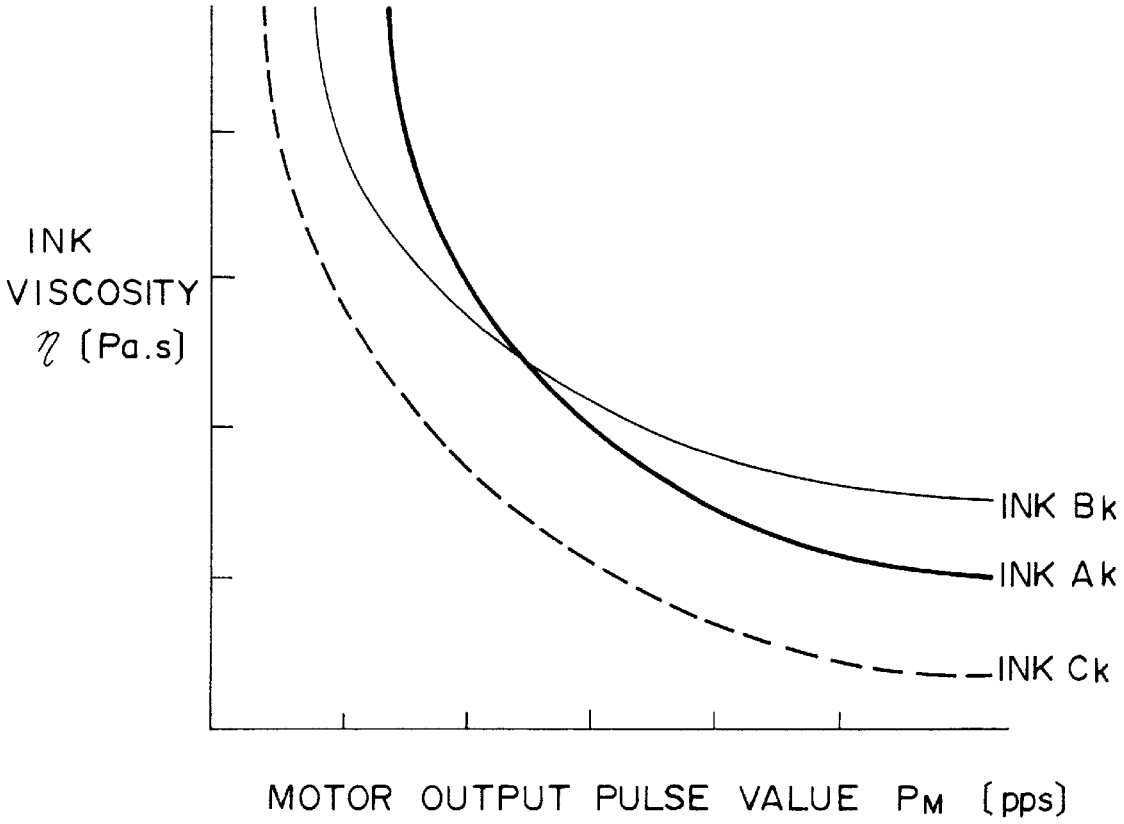
FIG. 19 is a graph showing a relation between the viscosity of ink and the output pulse value of the viscosity sense motor and particular to the alternative embodiment.

As for the relation between the ink viscosity and the number of pulses, the abscissa of the graph shown in FIG. 11, i.e., the motor output voltage V [V] should only be replaced with a motor output pulse value $P_M$ [pps] shown in FIG. 19. The value $P_M$ is representative of the number of pulses (frequency). Control pattern tables are prepared ink by ink in the same manner as in the previous embodiment, and stored in the ROM 132 beforehand. Specifically, as shown in FIG. 20, the abscissa indicates the motor output pulse values $P_M$ [pps] while the ordinate indicates the set print pressure [N] optimal for the instantaneous machine condition and the set number of pulses corresponding to the set print pressure.

Figure 20:
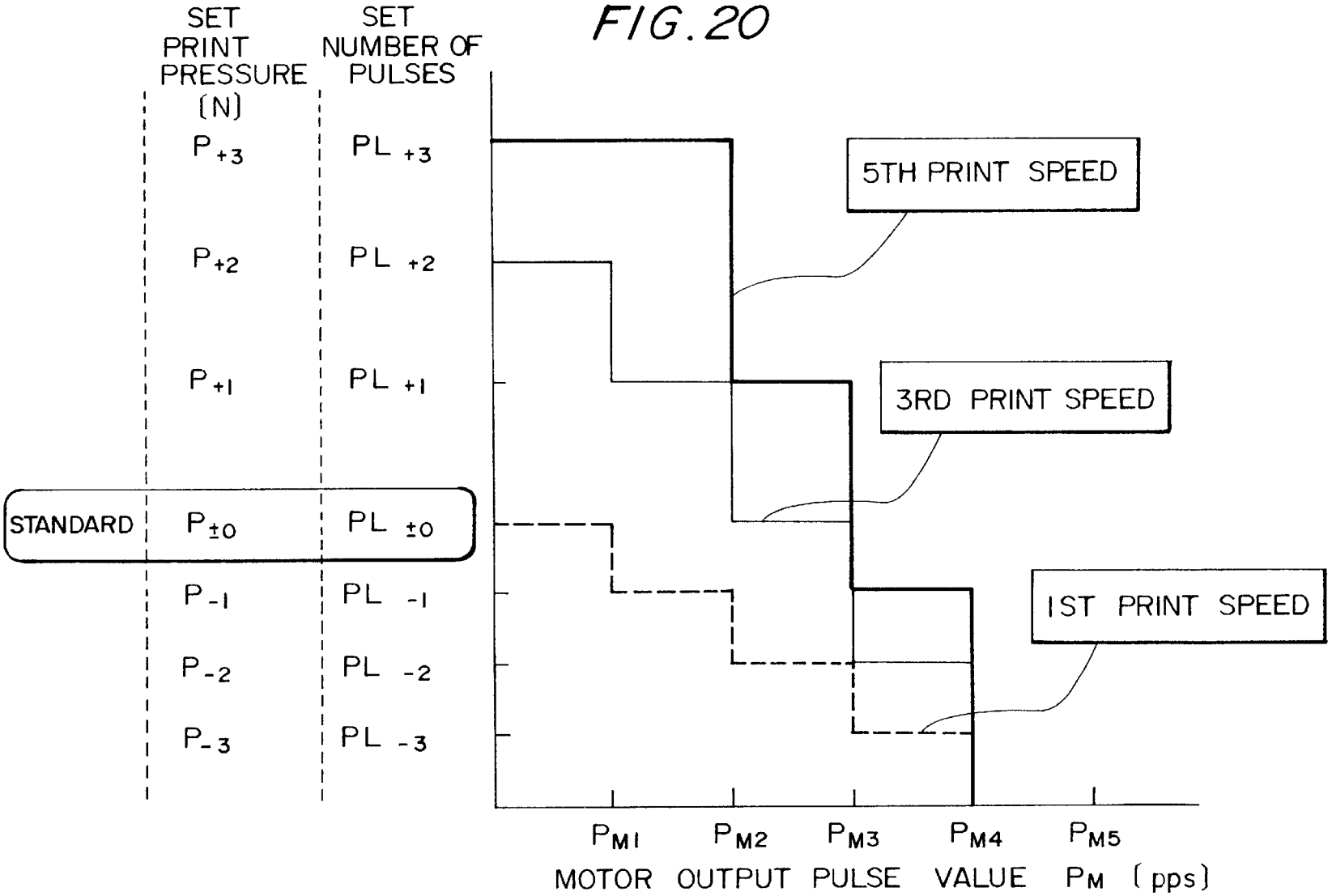
FIG. 20 is a graph representative of a control pattern table for setting a print pressure and included in the alternative embodiment.

The control pattern table shown in FIG. 20 is stored in the ROM 132 and determined by, e.g., experiments beforehand. A particular control pattern table is prepared for each kind of ink. The table shown in FIG. 20 is assigned to the black ink Ck by way of example. The first, third and fifth print speeds sequentially stepping down each are preset in conformity to the motor output pulse value $P_M$ [pps], the set print pressure, and number of pulses stated above. That is, the table shows that a preselected pressure, i.e., a set number of pulses corresponding to a set pressure [N] optimal for the instantaneous machine condition, is selected by using the motor output pulse value $P_M$ [pps] and the set print speed as parameters, i.e., in accordance with the viscosity signal and print speed set signal. Again, the first, third and fifth print speeds shown in FIG. 20 simply represent the various speeds available with the embodiment; the second and fourth speeds are omitted to better understand the operation of the embodiment.

This embodiment is free from electrical noise, is sharp and accurate in detection, and is capable of implementing more delicate print pressure control, compared to the previous embodiment and its modification using the analog current I or the analog voltage V. In addition, the illustrative embodiment is capable of controlling the print pressure adequately during printing while sensing the ink viscosity at all times.

Another alternative embodiment will be described with reference to FIGS. 3 and 7. This embodiment differs from the embodiment described first except that the drum unit sensor 35 is replaced with the kind-of-ink set key or kind-of-ink setting means 41 mentioned earlier. The key 41 is operated by the user who knows the kind of the ink stored in the print drum beforehand. The following description will concentrate on the difference between the two embodiments.

In this embodiment, the pressure variation control means 130 selects, out of the control pattern table, a preselected pressure in accordance with the ink viscosity sensed by the sensing means 21, the kind of the ink set on the kind-of-ink set key 41, and the print speed set on the print speed set key 47. Then, the control means 130 controls the pressure varying means 20 such that the above pressure acts on the print drum 101.

The illustrative embodiment determines the kind of the ink and controls the print pressure in the same manner as the first embodiment except for the following. When the operator inputs the kind of the ink of a desired drum unit on the key 41, a kind-of-ink set signal is fed from the key 41 to the CPU 131. At the same time, the LED assigned to the kind of the desired ink turns on.

The viscosity sense motor 17 should preferably be implemented by a DC motor from the cost, size, weight and noise standpoint. If desired, use may be made of a stepping motor, AC servo motor or similar motor in order to further promote accurate viscosity detection.

The viscosity sense roller 16 contacts the ink roller 120 via the ink layer at a position downstream of the gap between the ink roller 120 and the doctor roller 121, as stated earlier and as shown in, e.g., FIGS. 1 and 14. Such a position of the roller 16 is advantageous for the following reason. A load acting on the roller 16 due to the difference in the viscosity of ink is detected on the basis of the rotation of the roller 16. Therefore, the object whose ink viscosity should be measured (ink layer) should preferably be held under a constant condition. At the above particular position, the roller 16 is capable of measuring the ink layer regulated to a preselected thickness by the doctor roller 121, and therefore with higher accuracy.

However, the position of the roller 16 indicated by a solid line and a dashed line in FIGS. 1 and 14 is not restrictive. For example, assume a stencil printer in which a part of the ink layer on the ink roller 120 downstream of the gap between the roller 120 and the doctor roller 121 has a sufficient amount of ink in the axial range corresponding to the end portion or non-printing portion of the print drum 101. Then, the roller 16 may be replaced with a viscosity sense roller 16X located at a position indicated by a dash-and-dots line in FIG. 14. As shown, the roller 16X contacts the ink roller 120 via the ink layer in the above-mentioned range. One end of the roller 16X is connected to the output shaft 17*a* of the motor 17 while the shaft 17*a* is journalled to the left ink roller side wall mentioned previously.

If the advantage derived from the position of the viscosity sense roller 16 shown in FIG. 1 or 14 is not necessary, the viscosity sensing means 21, 21A or 21B may be modified, as follows. In a specific modification, the viscosity sense roller 16 or 16X is omitted from the sensing means 21, 21A or 21B, and the function of the roller 16 is assigned to the doctor roller 121 of the ink feeding means 119, as indicated by a phantom block in FIG. 7. In such a case, the doctor roller 121 plays the roll of the roller 16 at the same time.

Further, the viscosity sensing means may even be replaced with sensing means responsive to a change in the load of the ink pump or a change in the current or voltage to be applied to the ink pump drive motor.

Figure 15:
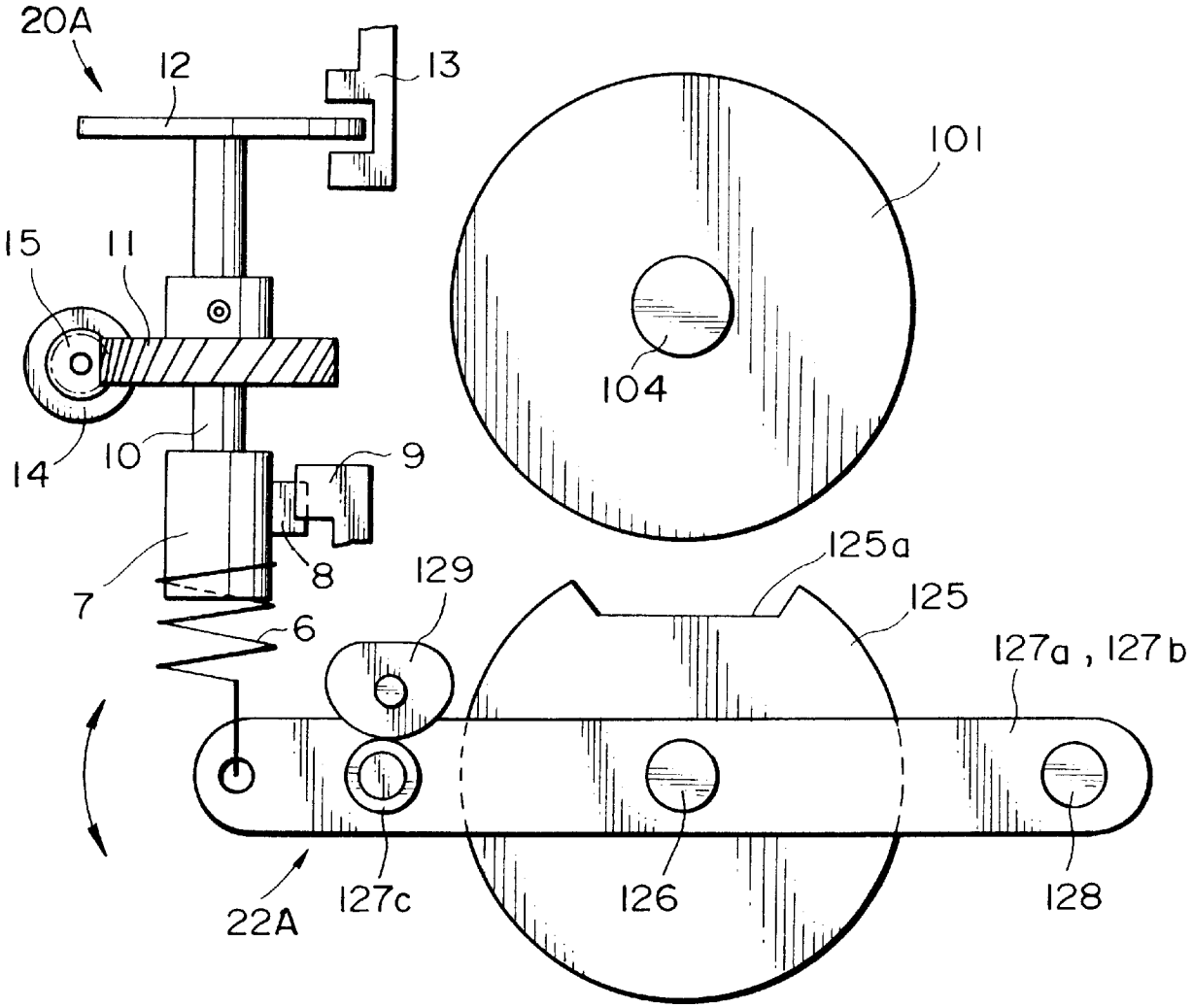
FIG. 15 is a front view showing another specific configuration of pressing means.

As shown in FIG. 15, the pressure varying means 20 included in the illustrative embodiments and modification may be replaced with pressure varying means 20A including a press drum or pressing means 125. As shown, the press drum 125 is formed with a notch 125*a* similar to a notch taught in Laid-Open Publication No. 5-201115 mentioned previously. In the pressure varying means 20A, the press roller moving means 22 is replaced with press drum moving means 22A for selectively moving the press drum 125 into or out of contact with the print drum 101.

The press drum moving means 22A includes a shaft 126 supporting the press drum 125. A right and a left arm 127*a* and 127*b* intervene between the shaft 126 and a shaft or fulcrum 128 located at the rear of the press drum 125, and each extends to the front in the direction of sheet transport X. The arms 127*a* and 127*b* are each rotatable about the fulcrum 128. A right and a left spring 6 are respectively anchored to the free ends of the arms 127*a* and 127*b*. A right and a left cam follower 127*c* are respectively mounted on the arms 127*a* and 127*b* between the free ends of the arms 127*a* and 127*b* and the shaft 126. A right and a left cam 129 are rotatably positioned in the vicinity of the right and left cam followers 127*c*, respectively, and each has a contour selectively contacting the respective cam follower 127*c*. The cams 129 are rotated in synchronism with the rotation of the print drum 101 by conventional means similar to the press roller drive means 150.

Of course, the press drum moving means 22A may be implemented by, e.g., an eccentric shaft as taught in Laid-Open Publication No. 5-201115, if desired.

The pressure control motor 14, encoder 12 and pulse sensor 13 included in the pressure varying means 20 or 20A may be replaced with a stepping motor, in which case the stepping motor will be controlled alone by a conventional rotation control system. Also, the means including in the pressure varying means 20 or 20A for varying the print pressure itself may be replaced with, e.g., an electric actuator or a solenoid, as proposed in Laid-Open Publication No. 6-340162 mentioned earlier.

For the sensing means responsive to the kind of ink, use may be made of dip switches 133 and 135 shown in, e.g., FIGS. 3 and 4 of Laid-Open Publication No. 6-199028 mentioned earlier, a bar code reader or similar code reader, a photoelectric sensor mounted on a color identifying portion of a print drum, or a sensor for directly sensing the color of ink to be fed to a print drum.

The ink feeding means 119 is only illustrative and may be replaced with, e.g., ink feeding means of the type feeding ink from the outside of a print drum, as disclosed in Laid-Open Publication No. 7-17013 mentioned earlier.

So long as the accuracy of viscosity measurement is not severely restricted, the viscosity sense roller 16 may be replaced with an extremely small rotatable roller or a n extremely small screw immersed in the ink well 122.

As to the combination of parameters for print pressure control, there may be combined the ink viscosity, the kind of ink sensed by the kind-of-ink sensing means or set on the kind-of-ink setting means, and the print speed.

In summary, it will be seen that the present invention provides a stencil printer and an ink viscosity sensing device having various unprecedented advantages, as enumerated below.

(1) An adequate print pressure can be set and controlled against the varying viscosity of ink ascribable to the environment and the kind of ink, without resorting t o complicated control pattern tables or a great number of sensors. This insures stable image quality.

(2) An adequate print pressure can be set and controlled not only against the varying viscosity of ink but also against variation in the set print speed, also insuring stable image quality.

(3) The viscosity of ink can be sensed immediately before printing. In addition, the viscosity can be sensed more adequately even when the viscosity differs from the inside of a print drum to that of an ink container.

(4) A change in current is detected by current sensing means and representative of the viscosity. Alternatively, a change in voltage is detected by voltage sensing means. This simplifies the measurement, compared to a direct measurement scheme.

(5) The viscosity is determined in terms of a change in the rotation speed of a viscosity sense roller, so that the viscosity can be sensed more delicately. Therefore, even during printing, the viscosity can be measured with high accuracy.

(6) The measurement is sparingly susceptible to electrical noise.

(7) The viscosity is sensed out of an ink layer regulated to a uniform thickness by a doctor roller. This enhances accurate measurement and does not effect the supply of the ink measured by the doctor roller and an ink roller to the ink roller.

(8) The doctor roller plays the role of the viscosity sense roller at the same time. This reduces the number of parts and therefore the overall size of the printer, while simplifying the printer.

(9) Pressing means is implemented by a press roller substantially identical in diameter with the print drum. This reduces noise when the pressing means is held in contact with the print drum.

Various modifications will become possible for those skilled in the art after receiving the teachings of the present disclosure without departing from the scope thereof.

What is claimed is:

1. A stencil printer for wrapping a master around a print drum, feeding ink to said master, and pressing a sheet against said print drum with pressing means to thereby print an image on said sheet, said stencil printer comprising:

an ink roller contacting an inner periphery of said print drum and for feeding ink to said print drum;

a doctor roller adjoining the ink roller at a position;

pressure varying means for varying a pressure of said pressing means acting on said print drum;

viscosity sensing means for sensing a viscosity of the ink at said ink roller, wherein said viscosity sensing means is located at the position where the ink roller and the doctor roller adjoin each other, and said viscosity sensing means contacts a downstream ink applying surface of the ink roller in a direction of rotation of the ink roller via an ink layer; and pressure variation control means for selecting, based on the viscosity sensed by said viscosity sensing means, a particular pressure of said pressing means out of a control pattern table prepared beforehand, and controlling said pressure varying means such that said particular pressure acts on said print drum.

2. A stencil printer for wrapping a master around a print drum, feeding ink to said master, and pressing a sheet against said print drum with pressing means to thereby print an image on said sheet, said stencil printer comprising:

an ink roller contacting an inner periphery of said print drum and for feeding ink to said print drum;

a doctor roller adjoining the ink roller at a position;

pressure varying means for varying a pressure of said pressing means acting on said print drum;

viscosity sensing means for sensing a viscosity of the ink at said ink roller, wherein said viscosity sensing means is located at the position where the ink roller and the doctor roller adjoin each other, and said viscosity sensing means contacts a downstream ink applying surface of the ink roller in a direction of rotation of the ink roller via an ink layer;

kind-of-ink sensing means for sensing a kind of the ink; and pressure variation control means for selecting, based on the viscosity sensed by said viscosity sensing means and the kind of the ink sensed by said kind-of-ink sensing means, a particular pressure of said pressing means out of a control pattern table prepared beforehand, and controlling said pressure varying means such that said particular pressure acts on said print drum.

3. A stencil printer for wrapping a master around a print drum, feeding ink to said master, and pressing a sheet against said print drum with pressing means to thereby print an image on said sheet, said stencil printer comprising:

an ink roller contacting an inner periphery of said print drum and for feeding ink to said print drum;

a doctor roller adjoining the ink roller at a position;

pressure varying means for varying a pressure of said pressing means acting on said print drum;

viscosity sensing means for sensing a viscosity of the ink at said ink roller, wherein said viscosity sensing means is located at the position where the ink roller and the doctor roller adjoin each other, and said viscosity sensing means contacts a downstream ink applying surface of the ink roller in a direction of rotation of the ink roller via an ink layer;

kind-of-ink setting means for allowing a kind of the ink to be set thereon; and pressure variation control means for selecting, based on the viscosity sensed by said viscosity sensing means and the kind of the ink set on said kind-of-ink setting means, a particular pressure of said pressing means out of a control pattern table prepared beforehand, and controlling said pressure varying means such that said particular pressure acts on said print drum.

4. A stencil printer for wrapping a master around a print drum, feeding ink to said master, and pressing a sheet against said print drum with pressing means to thereby print an image on said sheet, said stencil printer comprising:

an ink roller contacting an inner periphery of said print drum and for feeding ink to said print drum;

a doctor roller adjoining the ink roller at a position;

pressure varying means for varying a pressure of said pressing means acting on said print drum;

viscosity sensing means for sensing a viscosity of the ink at said ink roller, wherein said viscosity sensing means is located at the position where the ink roller and the doctor roller adjoin each other, and said viscosity sensing means contacts a downstream ink applying surface of the ink roller in a direction of rotation of the ink roller via an ink layer;

print speed setting means for allowing a variable print speed of said stencil printer to be selectively set thereon; and pressure variation control means for selecting, based on the viscosity sensed by said viscosity sensing means and the print speed set on said print speed setting means, a particular pressure of said pressing means out of a control pattern table prepared beforehand, and controlling said pressure varying means such that said particular pressure acts on said print drum.

5. A stencil printer for wrapping a master around a print drum, feeding ink to said master, and pressing a sheet against said print drum with pressing means to thereby print an image on said sheet, said stencil printer comprising:

an ink roller contacting an inner periphery of said print drum and for feeding ink to said print drum;

a doctor roller adjoining the ink roller at a position;

pressure varying means for varying a pressure of said pressing means acting on said print drum;

viscosity sensing means for sensing a viscosity of the ink at said ink roller, wherein said viscosity sensing means is located at the position where the ink roller and the doctor roller adjoin each other, and said viscosity sensing means contacts a downstream ink applying surface of the ink roller in a direction of rotation of the ink roller via an ink layer;

kind-of-ink sensing means for sensing a kind of the ink;

print speed setting means for allowing a variable print speed to be selectively set thereon; and pressure variation control means for selecting, based on the viscosity sensed by said viscosity sensing means, the kind of the ink sensed by said kind-of-ink sensing means, and the print speed set on said print speed setting means, a particular pressure of said pressing means out of a control pattern table prepared beforehand, and controlling said pressure varying means such that said particular pressure acts on said print drum.

6. A stencil printer for wrapping a master around a print drum, feeding ink to said master, and pressing a sheet against said print drum with pressing means to thereby print an image on said sheet, said stencil printer comprising:

an ink roller contacting an inner periphery of said print drum and for feeding ink to said print drum;

a doctor roller adjoining the ink roller at a position;

pressure varying means for varying a pressure of said pressing means acting on said print drum;

viscosity sensing means for sensing a viscosity of the ink at said ink roller, wherein said viscosity sensing means is located at the position where the ink roller and the doctor roller adjoin each other, and said viscosity sensing means contacts a downstream ink applying surface of the ink roller in a direction of rotation of the ink roller via an ink layer;

kind-of-ink setting means for allowing a kind of the ink to be set thereon;

print speed setting means for allowing a variable print speed to be selectively set thereon; and pressure variation control means for selecting, based on the viscosity sensed by said viscosity sensing means, the kind of the ink set on said kind-of-ink setting means, and the print speed set on said print speed setting means, a particular pressure of said pressing means out of a control pattern table prepared beforehand, and controlling said pressure varying means such that said particular pressure acts on said print drum.

* * * * *

UNITED STATES PATENT AND TRADEMARK OFFICE

CERTIFICATE OF CORRECTION

PATENT NO. : 6,095,040

DATED : August 1, 2000

INVENTOR(S): Atsushi Ashikagaya, et al.

It is certified that an error appears in the above-identified patent and that said Letters Patent is hereby corrected as shown below:

In column 8, line 26, change "Sa" to --5a--.
In column 9, line 13, change "111" to --101--.
In column 9, line 28, in second occurrence, change "in k" to --ink--.
In column 9, line 39, change "aventurin" to --aventurine--.
In column 9, line 56, change "name" to --have--.
In column 12, line 34, change "b y" to --by--.
In column 15, line 15, change "110" to --I/0--.
In column 20, line 23, in second occurrence, change "a n" to --an--.
In column 20, line 36, change "t o" to --to--.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*